US011208868B2

(12) United States Patent
Marya

(10) Patent No.: US 11,208,868 B2
(45) Date of Patent: Dec. 28, 2021

(54) FRANGIBLE DEGRADABLE MATERIALS

(71) Applicant: Schlumberger Technology Corporation, Sugar Land, TX (US)

(72) Inventor: Manuel P. Marya, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/037,616

(22) PCT Filed: Nov. 18, 2014

(86) PCT No.: PCT/US2014/066136
§ 371 (c)(1),
(2) Date: May 18, 2016

(87) PCT Pub. No.: WO2015/077225
PCT Pub. Date: May 28, 2015

(65) Prior Publication Data

US 2016/0290098 A1 Oct. 6, 2016

Related U.S. Application Data

(60) Provisional application No. 61/905,883, filed on Nov. 19, 2013.

(51) Int. Cl.

| | |
|---|---|
| ***E21B 34/06*** | (2006.01) |
| ***E21B 33/13*** | (2006.01) |
| ***E21B 43/12*** | (2006.01) |
| ***E21B 43/26*** | (2006.01) |
| *C22C 21/00* | (2006.01) |
| *E21B 33/12* | (2006.01) |
| *E21B 43/08* | (2006.01) |
| *E21B 47/12* | (2012.01) |

(52) U.S. Cl.
CPC ..... *E21B 34/063* (2013.01); *E21B 33/13* (2013.01); *E21B 43/12* (2013.01); *E21B 43/26* (2013.01); *C22C 21/00* (2013.01); *E21B 33/12* (2013.01); *E21B 43/08* (2013.01); *E21B 47/12* (2013.01)

(58) Field of Classification Search
CPC ..... E21B 34/063; E21B 33/13; E21B 33/12; E21B 43/26; E21B 43/12; E21B 43/08; E21B 47/12; C22C 21/00
See application file for complete search history.

(56) References Cited

U.S. PATENT DOCUMENTS 5,422,066 A * 6/1995 Webster ..... C22C 21/00 148/415
7,350,582 B2 * 4/2008 McKeachnie ..... E21B 33/1294 166/194
8,211,247 B2 7/2012 Marya et al.
(Continued)

OTHER PUBLICATIONS

Alloying: Understading the Basics, J.R. Davis, p. 351-416, DOI:10.1361/autb2001p351 (Year: 2001).*
(Continued)

*Primary Examiner* — Nicole Coy
*Assistant Examiner* — Yanick A Akaragwe
(74) *Attorney, Agent, or Firm* — Matthew Goode

(57) ABSTRACT

A borehole tool can include a frangible degradable alloy that includes an oxidizable base element and at least one alloying element.

22 Claims, 14 Drawing Sheets

(56) References Cited

U.S. PATENT DOCUMENTS

| | | | | |
|---|---|---|---|---|
| 8,211,248 | B2 | 7/2012 | Marya | |
| 8,584,746 | B2 | 11/2013 | Marya et al. | |
| 2003/0010565 | A1* | 1/2003 | Brooks | G01V 1/13 181/116 |
| 2007/0044958 | A1 | 3/2007 | Rytlewski et al. | |
| 2007/0181224 | A1* | 8/2007 | Marya | C09K 8/805 148/400 |
| 2010/0032151 | A1* | 2/2010 | Duphorne | E21B 23/02 166/55 |
| 2010/0209288 | A1* | 8/2010 | Marya | C22C 21/00 420/541 |
| 2010/0294510 | A1 | 11/2010 | Holmes | |
| 2013/0133897 | A1 | 5/2013 | Bahly et al. | |

OTHER PUBLICATIONS

PCT/US2014/066136 International Search Report and Written Opinion, dated Feb. 25, 2015, 15 pgs.

Tal-Gutelmacher et al., Hydrogen-Assisted Degradation of Titanium Based Alloys, Materials Transations, vol. 45, No. 5 (2004) pp. 1594 to 1600.

Marchi et al., Technical Reference on Hydrogen Compatibility of Materials—Aluminum Alloys, Non-Heat Treatable Alloys: Pure Aluminum (code 3101), Sandia Laboratories, Apr. 5, 2007 (6 pages).

Sukiman et al., Durability and Corrosion of Aluminum and its Alloys: Overview, Property Space: Techniques and Developments, Aluminum Alloys—New Trends in Fabrication and Applications, Chapter 2, 2013, Intech (52 pages).

Kamoutsi et al., Corrosion-induced hydrogen embrittlement in aluminum alloy 2024, Corrosion Science 48 (2006) pp. 1209-1224.

Winzer et al., Stress Corrosion Cracking in Magnesium Alloys: Characterization and Prevention, Research Summary, Magnesium: Fundamental Research, Aug. 2007 (5 pages).

Wikipedia_Stress_Corrosion_Cracking, downloaded Nov. 8, 2014 (5 pages).

International Preliminary Report on Patentability issued in PCT/US2014/066136, dated May 24, 2016 (9 pages).

* cited by examiner

FRANGIBLE DEGRADABLE MATERIALS

RELATED APPLICATION

This application claims the benefit of and priority to a U.S. Provisional Patent Application having Ser. No. 61/905,883, filed 19 Nov. 2013, which is incorporated by reference herein.

BACKGROUND

Various types of materials are used in equipment, operations, etc. for exploration, development and production of resources from geologic environments. For example, equipment may be used in one or more of a sensing operation, a drilling operation, a cementing operation, a fracturing operation, a production operation, etc.

SUMMARY

A borehole tool can include a frangible degradable alloy that includes an oxidizable base element and at least one alloying element. A borehole tool can include a frangible degradable material that includes metallic grains where adjacent grains form hydrogen traps and form grain boundaries that transport aqueous solution. A method can include positioning a borehole tool in a downhole environment where the borehole tool includes an age-hardenable material; and prior to a predetermined age hardening time, degrading the age-hardenable material via exposure to an aqueous solution. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

Figure 1:
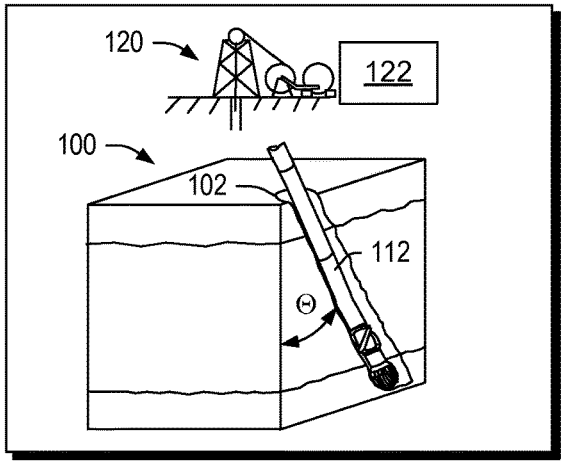
FIG. 1 illustrates examples of an environment, equipment and an assembly.
Figure 1:
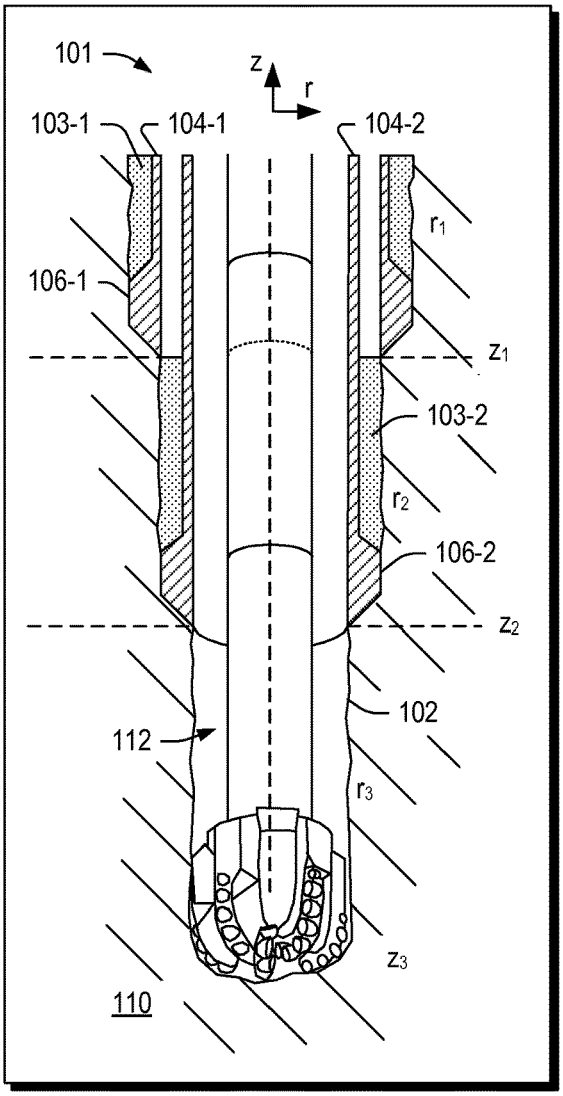
Figure 1:
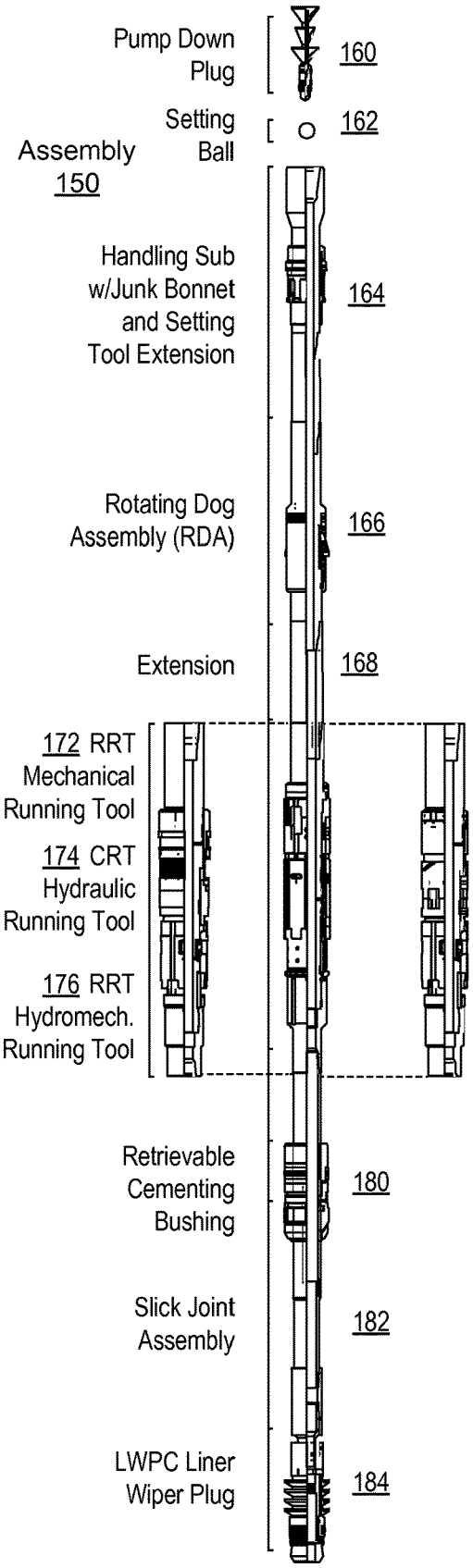

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

As an example, a material or materials may be frangible. For example, a frangible material may break up into fragments. As an example, a borehole tool may be made at least in part from a frangible material such that upon exposure to a condition, a range of conditions, etc. that material breaks into fragments. As an example, a frangible material may be machined, formed, etc. to produce a part or parts. As an example, a part may be a component or a portion of a component. A part may be included in equipment, which may be suitable for use in an environment such as, for example, a downhole environment. As an example, equipment may be drilling equipment, cementing equipment, fracturing equipment, sampling equipment, or other type of equipment. As an example, equipment may be borehole equipment. As an example, a tool may be a borehole tool, for example, suitable to perform a function or functions in a downhole environment in a borehole.

As an example, a frangible degradable material may be a material susceptible to environmentally-assisted cracking. Such cracking may be achieved via one or more mechanisms. For example, a cracking mechanism may be a stress corrosion cracking mechanism.

As an example, a material or materials may be degradable by one or more mechanisms. For example, consider a material that is frangible degradable, a material that is dissolution degradable or a material that is frangible degradable and dissolution degradable. As an example, a degradable material may be machined, formed, etc. to produce a part or parts. As an example, a part may be a component or a portion of a component. A part may be included in equipment, which may be suitable for use in an environment such as, for example, a downhole environment. As an example, equipment may be drilling equipment, cementing equipment, fracturing equipment, sampling equipment, or other type of equipment. As an example, equipment may be borehole equipment. As an example, a tool may be a borehole tool, for example, suitable to perform a function or functions in a downhole environment in a borehole.

As an example, a material may degrade downhole. Such a material may form a borehole tool or a part of a borehole tool. As an example, a borehole tool may be a tool suitable for performing multi-stage fracturing, cementing, etc. As an example, a material may internally fracture (e.g., collapse) as a result of environmental fluid (e.g., water, etc.) ingress and formation of in situ stress corrosion cracking (SCC) "cells". Such a material may be referred to as a frangible degradable material. As an example, a material may be subject to a fluid or fluids in an environment that cause the material to undergo environmentally-assisted cracking, which may degrade the material (e.g., for one or more purposes).

As to cementing equipment, such equipment may be used in one or more downhole cementing operations. As an example, cement may be placed adjacent to a liner. As an example, a liner may be a string of casing in which the top does not extend to the surface but instead is suspended from inside another casing string. As an example, a liner hanger may be used to attach or hang one or more liners from an internal wall of another casing string.

As an example, a method may include operating one or more components of a liner hanger system. As an example, a lower completion may be a portion of a well that is at least in part in a production zone or an injection zone. As an example, a liner hanger system may be implemented to perform one or more operations associated with a lower completion, for example, including setting one or more components of a lower completion, etc. As an example, a liner hanger system may anchor one or more components of a lower completion to a production casing string.

FIG. 1 shows an example of an environment 100, an example of a portion of a completion 101, an example of equipment 120 and an example of an assembly 150, which may be part of a liner hanger system. As an example, the equipment 120 may include a rig, a turntable, a pump, drilling equipment, pumping equipment, equipment for deploying an assembly, a part of an assembly, etc. As an example, the equipment 120 may include one or more controllers 122. As an example, a controller may include one or more processors, memory and instructions stored in memory that are executable by a processor, for example, to control one or more pieces of equipment (e.g., motors, pumps, sensors, etc.). As an example, the equipment 120 may be deployed at least in part at a well site and, optionally, in part at a remote site.

FIG. 1 shows an environment 100 that includes a subterranean formation into which a bore 102 extends where a tool 112 such as, for example, a drill string is disposed in the bore 102. As an example, the bore 102 may be defined in part by an angle (Θ); noting that while the bore 102 is shown as being deviated, it may be vertical (e.g., or include one or more vertical sections along with one or more deviated sections). As shown in an enlarged view with respect to an r, z coordinate system (e.g., a cylindrical coordinate system), a portion of the bore 102 includes casings 104-1 and 104-2 having casing shoes 106-1 and 106-2. As shown, cement annuli 103-1 and 103-2 are disposed between the bore 102 and the casings 104-1 and 104-2. Cement such as the cement annuli 103-1 and 103-2 can support and protect casings such as the casings 104-1 and 104-2 and when cement is disposed throughout various portions of a wellbore such as the wellbore 102, cement may help achieve zonal isolation.

In the example of FIG. 1, the bore 102 has been drilled in sections or segments beginning with a large diameter section (see, e.g., $r_1$) followed by an intermediate diameter section (see, e.g., $r_2$) and a smaller diameter section (see, e.g., $r_3$). As an example, a large diameter section may be a surface casing section, which may be three or more feet in diameter and extend down several hundred feet to several thousand feet. A surface casing section may aim to prevent washout of loose unconsolidated formations. As to an intermediate casing section, it may aim to isolate and protect high pressure zones, guard against lost circulation zones, etc. As an example, intermediate casing may be set at about 6000 feet and extend lower with one or more intermediate casing portions of decreasing diameter (e.g., in a range from about thirteen to about five inches in diameter). A so-called production casing section may extend below an intermediate casing section and, upon completion, be the longest running section within a wellbore (e.g., a production casing section may be thousands of feet in length). As an example, production casing may be located in a target zone where the casing is perforated for flow of fluid into a bore of the casing.

Prior to introducing cement into an annulus between a bore and a casing, calculations may be performed to estimate an amount of cement sufficient to fill the annulus, for example, for purposes of sealing off a casing segment. Accuracy of an estimate as to the amount of cement as well as issues in a process of introducing cement may, for example, result in occasional voids or gaps (e.g., regions where cement is lacking).

As an example, a string may include one or more tools such as, for example, a logging while drilling (LWD) tool, which may carry one or more transmitters and one or more receivers. For example, the SONICSCOPE™ tool marketed by Schlumberger Ltd. (Houston, Tex.) carries a wideband multipole transmitter and wideband receivers. The multipole transmitter provides for transmission of high-frequency monopole energy (e.g., for compressional and shear slowness in fast formation), low-frequency monopole energy (e.g., for Stoneley waves) and quadrupole energy (e.g., for shear slowness in slow formations). The wideband receivers provide for digitization of sensed signals and inter-receiver sampling to address aliasing. As an example, a tool may include circuitry to sense information as to regions proximate to a bore. As an example, a tool may include circuitry to determine one or more cement-related parameters (e.g., extent of cement, cement quality, voids, etc.). As an example, a controller may include an interface to receive information from one or more sensors.

As mentioned, a liner may be a casing (e.g., a completion component). As mentioned, a liner may be installed via a liner hanger system. As an example, a liner hanger system may include various features such as, for example, one or more of the features of the assembly 150 of FIG. 1.

As shown in FIG. 1, the assembly 150 can include a pump down plug 160, a setting ball 162, a handling sub with a junk bonnet and setting tool extension 164, a rotating dog assembly (RDA) 166, an extension(s) 168, a mechanical running tool 172, a hydraulic running tool 174, a hydromechanical running tool 176, a retrievable cementing bushing 180, a slick joint assembly 182 and/or a liner wiper plug 184. As an example, a plug may be an object that can be seated, for example, to seal an opening. As an example, the pump down plug 160 and the setting ball 162 may be plugs. As an example, a plug tool may be a tool that includes at least one seat to seat a plug. For example, a plug tool may include a seat that can seat a plug shaped as a ball (e.g., a spherical plug), as a cylinder (e.g., a cylindrical plug), or other shaped plug.

As an example, an assembly may include a liner top packer with a polished bore receptacle (PBR), a coupling(s), a mechanical liner hanger, a hydraulic liner hanger, a hydraulic liner hanger, a liner(s), a landing collar with a ball seat, a landing collar without a ball seat, a float collar, a liner joint or joints and/or a float shoe and/or a reamer float shoe.

As an example, a method can include a liner hanger setting procedure. Such a procedure may include positioning a liner shoe at a depth at which a hanger is to be set, dropping a setting ball from a ball dropping sub of a cementing manifold, gravitating or pumping the ball down to a ball catch landing collar, reducing the pump rate when the ball is expected to seat, increasing pressure, which pressure may act through setting ports of a hanger body and set slips on to a casing, and while holding the hanger setting pressure, setting the liner hanger by slacking off the liner weight on the hanger slips, where a loss of weight may be indicated on a weight gauge as the liner hanger sets.

In the foregoing example, it may be desirable that the ball (see, e.g., the ball 162) has properties suited for one or more operation or operations. Properties may include mechanical properties and may include one or more other types of properties (e.g., chemical, electrical, etc.). As an example, it may be desirable that the ball degrades. For example, a ball may be manufactured with properties such that the ball degrades when exposed to one or more conditions (e.g., consider environmentally-assisted cracking). In such an example, where the ball acts to block a passage, upon degradation, the passage may become unblocked. As an example, a ball or other component (e.g., a plug, etc.) may degrade in a manner that facilitates one or more operations. As an example, a component or a portion of a component may degrade in stages. For example, consider a plug that degrades from a first size to a second smaller size. In such an example, the second smaller size may allow the plug to move (e.g., from a first seat to a second seat, etc.). As an example, a plug tool may be a degradable tool. As an example, a plug tool may be degradable in part (e.g., consider a frangible degradable plug). For example, consider a plug tool with a degradable seat or degradable seats. In such an example, a plug may be seated in a degradable seat that upon degradation of the seat, the plug may pass through the seat (e.g., become unplugged with respect to that seat). As an example, a system can include a plug tool that is degradable at least in part and one or more degradable plugs (e.g., balls, cylinders, etc.).

Figure 2:
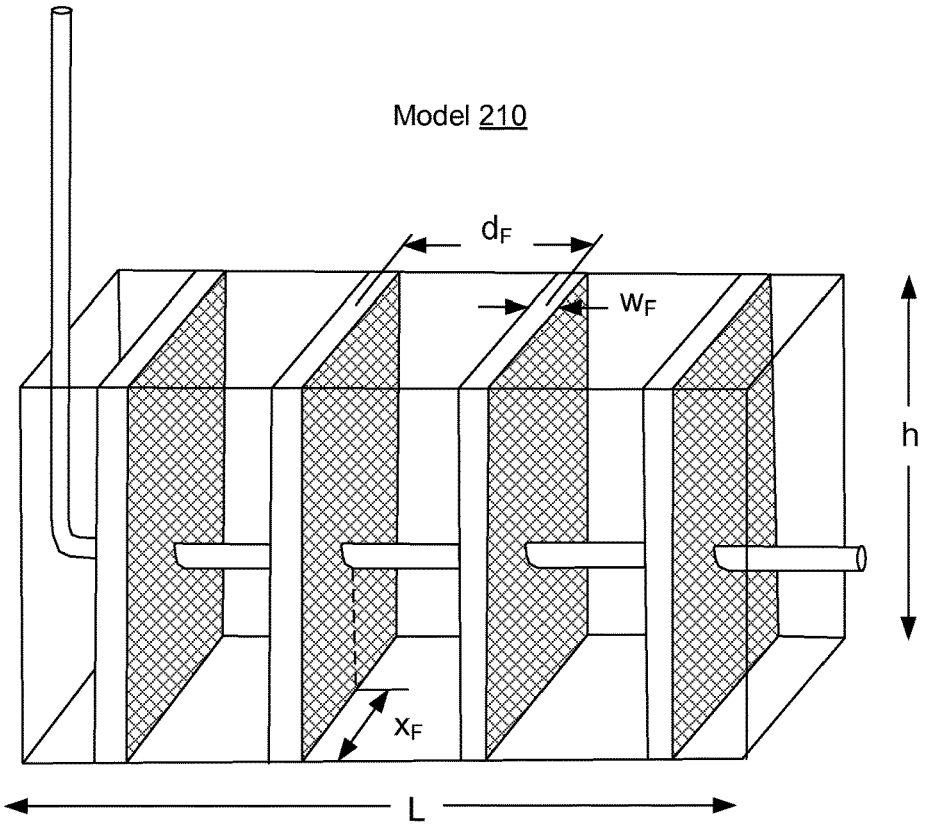
FIG. 2 illustrates an example of a model and an example of an operation.
Figure 2:
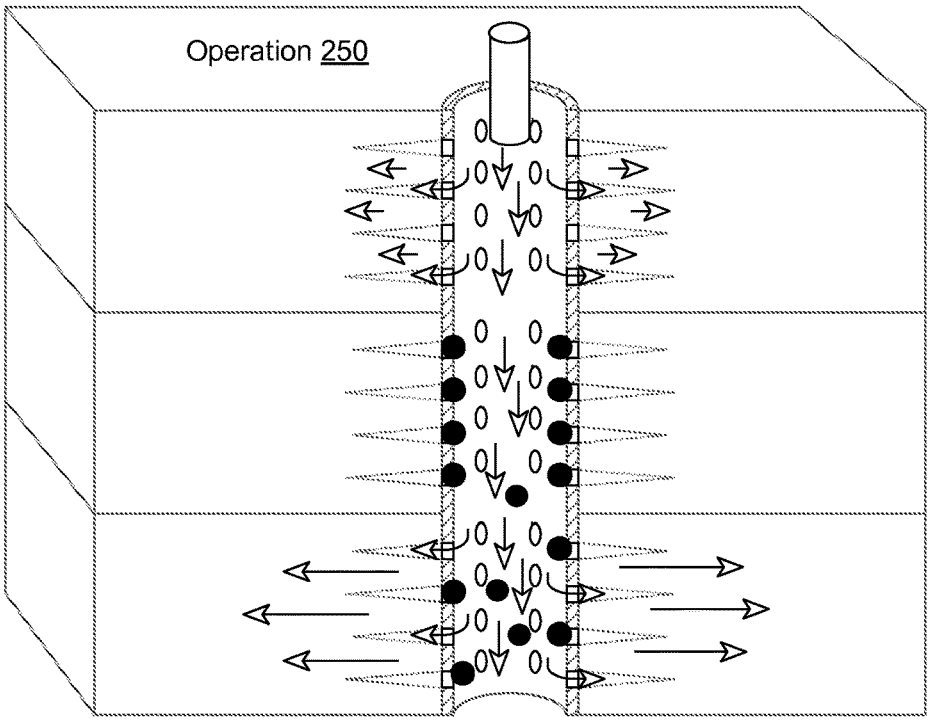

FIG. 2 shows an example of a model 210 of a fracturing operation and an example of plugs (e.g., balls, etc.) as may be used in a fracturing operation 250, for example, to generate fractures in an environment according to the model 210.

Resource recovery from a geologic environment may benefit from application of one or more enhanced recovery techniques. For example, a geologic environment may be artificially fractured to increase flow of fluid from a reservoir to a well. As an example, consider hydraulic fracturing where fluid pressure is applied to a subterranean environment to generate fractures that can act as flow channels. Hydraulic fracturing may be planned in advance, for example, to develop a region, which may be referred to as a drainage area. Hydraulic fracturing may be analyzed during or post-fracturing. As an example, hydraulic fracturing may occur in stages where a later stage may be planned at least in part based on information associated with one or more earlier stages.

In FIG. 2, the model 210 includes a horizontal well intersected by multiple transverse vertical hydraulic fractures. Equations may be associated with the model 210 such as, for example, equations that depend on dimensions and properties of the vertical fractures. As an example, consider a trilinear model that includes equations for analysis of low-permeability (e.g., micro- and nano-Darcy range) fractured shale reservoirs according to three linear flow regions. Such a model may help to characterize a drainage area completed with one or more horizontal wells that intersect multiple transverse vertical fractures. Such a model may assist with planning and other aspects of field development, operations, etc.

As an example, a model can include constructs that model, for example, a matrix, a well, natural fractures, hydraulic fractures, activated fractures and a stimulated inter-hydraulic fracture region. In the example of FIG. 2, the model 210 may encompass a drainage area, for example, defined as covering a surface area and as having a depth or depths. Given parameter values for the various constructs (e.g., locations, characteristics, etc.), the model 210 may be formulated with respect to a grid to form a numerical model suitable for providing solutions via a numerical solver.

As an example, a method can includes a delivery block for delivering fluid to a subterranean environment, a monitor block for monitoring fluid pressure and a generation block for generating fractures via fluid pressure. As an example, the generation block may include activating one or more fractures. As an example, the generation block may include generating and activating fractures. As an example, activation may occur with respect to a pre-existing feature such as a fault or a fracture. As an example, a pre-existing fracture network may be at least in part activated via a method that includes applying fluid pressure in a subterranean environment. The foregoing method may be referred to as a treatment method or a "treatment". Such a method may include pumping an engineered fluid (e.g., a treatment fluid) at high pressure and rate into a reservoir via one or more bores, for example, to one or more intervals to be treated, which may cause a fracture or fractures to open (e.g., new, pre-existing, etc.).

As an example, a fracture may be defined as including "wings" that extend outwardly from a bore. Such wings may extend away from a bore in opposing directions, for example, according in part to natural stresses within a formation. As an example, proppant, such as grains of sand of a particular size, may be mixed with a treatment fluid to keep a fracture (or fractures) open when a treatment is complete. Hydraulic fracturing may create high-conductivity communication with an area of a formation and, for example, may bypass damage that may exist in a near-wellbore area. As an example, stimulation treatment may occur in stages. For example, after completing a first stage, data may be acquired and analyzed for planning and/or performance of a subsequent stage.

Size and orientation of a fracture, and the magnitude of the pressure to create it, may be dictated at least in part by a formation's in situ stress field. As an example, a stress field may be defined by three principal compressive stresses, which are oriented perpendicular to each other. The magnitudes and orientations of these three principal stresses may be determined by the tectonic regime in the region and by depth, pore pressure and rock properties, which determine how stress is transmitted and distributed among formations.

Where fluid pressure is monitored, a sudden drop in pressure can indicate fracture initiation of a stimulation treatment, as fluid flows into the fractured formation. As an example, to break rock in a target interval, fracture initiation pressure exceeds a sum of the minimum principal stress plus the tensile strength of the rock. To determine fracture closure pressure, a process may allow pressure to subside until it indicates that a fracture has closed. A fracture reopening pressure may be determined by pressurizing a zone until a leveling of pressure indicates the fracture has reopened. The closure and reopening pressures tend to be controlled by the minimum principal compressive stress (e.g., where induced downhole pressures exceed minimum principal stress to extend fracture length).

After performing fracture initiation, a zone may be pressurized for furthering stimulation treatment. As an example, a zone may be pressurized to a fracture propagation pressure, which is greater than a fracture closure pressure. The difference may be referred to as the net pressure, which represents a sum of frictional pressure drop and fracture-tip resistance to propagation (e.g., further propagation).

As an example, a method may include seismic monitoring during a treatment operation (e.g., to monitor fracture initiation, growth, etc.). For example, as fracturing fluid forces rock to crack and fractures to grow, small fragments of rock break, causing tiny seismic emissions, called microseisms. Equipment may be positioned in a field, in a bore, etc. to sense such emissions and to process acquired data, for example, to locate microseisms in the subsurface (e.g., to locate hypocenters). Information as to direction of fracture growth may allow for actions that can "steer" a fracture into a desired zone(s) or, for example, to halt a treatment before a fracture grows out of an intended zone.

Referring to the operation 250 of FIG. 2, as indicated, fracturing may be performed by using plugs, which may be shaped as balls (e.g., spheres). In such an example, openings may be plugged, for example, to preferentially direct fluid. The operation 250, while illustrated as being vertical in FIG. 2, may be horizontal or at another deviated angle.

In an operation such as the operation 250 of FIG. 2, it may be desirable that the plugs have properties suited to such an operation and, for example, one or more subsequent operations. Properties may include mechanical properties and may include one or more other types of properties (e.g., chemical, electrical, etc.). As an example, it may be desirable that a plug degrade, that a plug seat degrades, that at least a portion of a borehole tool degrades, etc. For example, a plug may be manufactured with properties such that the plug degrades when exposed to one or more conditions (e.g., consider environmentally-assisted cracking). In such an example, where the plug acts to block a passage, upon degradation (e.g., cracking into pieces, etc.), the passage may become unblocked. As an example, a plug or other component (e.g., a dart, etc.) may degrade in a manner that facilitates one or more operations. As an example, a component or a portion of a component may degrade in stages. For example, consider a plug that degrades from a first size to a second smaller size. In such an example, the second smaller size may allow the plug to move (e.g., from a first seat to a second seat, etc.). As an example, a plug seat may be degradable and degrade to a predefined size that may allow passage of a plug. For example, consider a plug seat of a plug tool, which may be a fracing related plug tool, a cementing related plug tool, etc.

Figure 3:
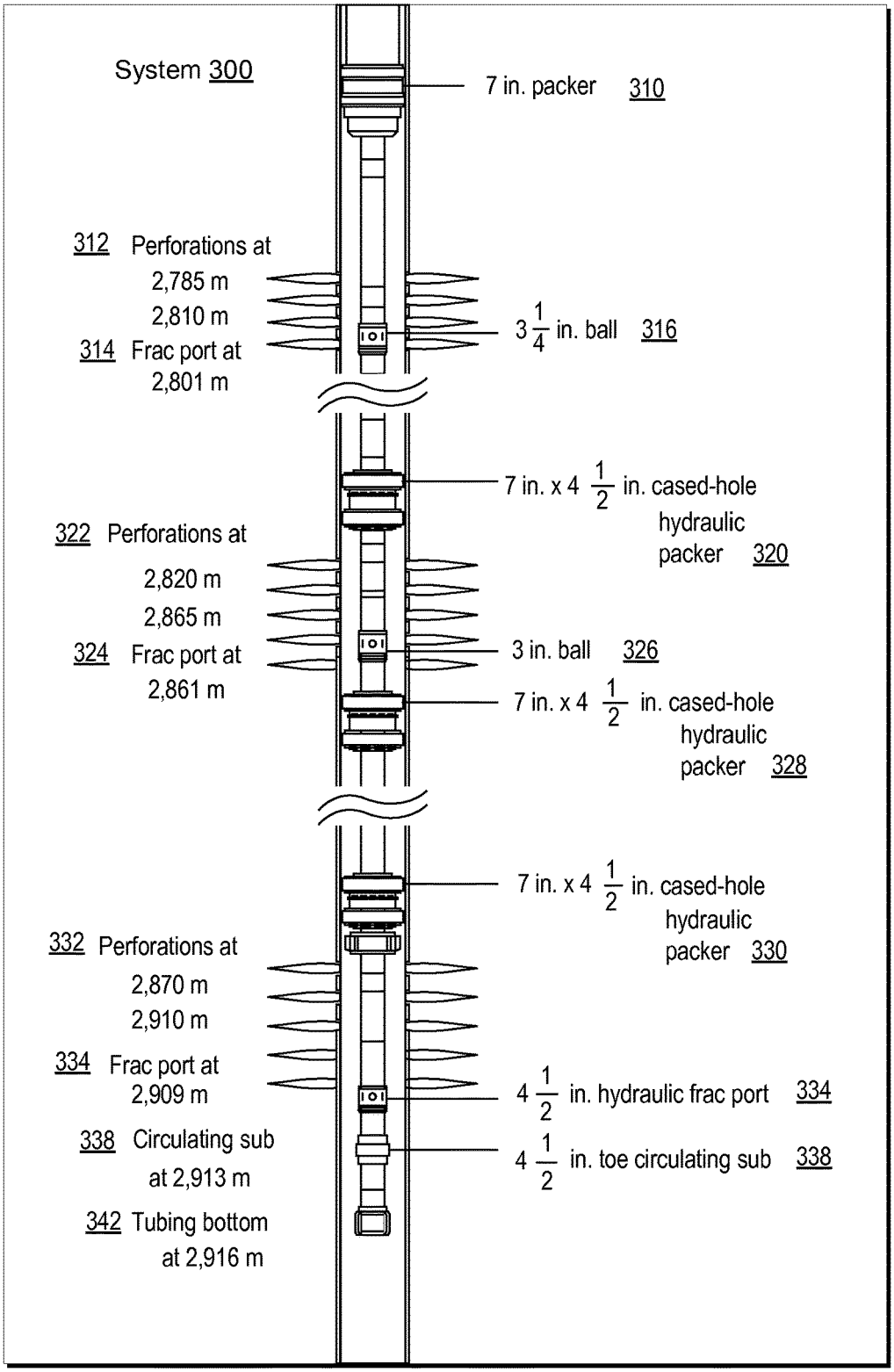
FIG. 3 illustrates an example of a system.

FIG. 3 shows an example of a system 300 that includes a packer 310, perforations 312, a frac port 314, a first size ball 316 (e.g., in a first size ball seat), a packer 320, perforations 322, a frac port 324, a second size ball 326 (e.g., in a second size ball seat), a packer 328, a packer 330, perforations 332, a frac port 334, a circulating sub 338 and a tubing bottom 342. The system 300, while illustrated as being vertical in FIG. 3, may be horizontal or at another deviated angle. As an example, a frac port may be part of a tool. For example, a frac port may be part of a plug tool. As an example, a frac valve may be part of a tool. As an example, a frac valve may operate with respect to a plug, a sliding member, etc. As an example, a plug tool may include at least one seat that can seat a plug (e.g., a ball, etc.), for example, to seal an opening or openings. As an example, a plug tool and/or a plug may be at least in part degradable.

In a system such as the system 300 of FIG. 3, it may be desirable that the balls 316 and 326 have properties suited to such a system and, for example, one or more operations (see, e.g., the operation 250 of FIG. 2, etc.). Properties may include mechanical properties and may include one or more other types of properties (e.g., chemical, electrical, etc.). As an example, it may be desirable that the balls 316 and 326 degrade (e.g., via one or more mechanisms). For example, a ball may be manufactured with properties such that the ball degrades when exposed to one or more conditions (e.g., consider environmentally-assisted cracking). In such an example, where the ball acts to block a passage, upon degradation, the passage may become unblocked. As an example, a ball or other component (e.g., a dart, a plug, etc.) may degrade in a manner that facilitates one or more operations. As an example, a component or a portion of a component may degrade in stages. For example, consider a ball that degrades from a first size to a second smaller size. In such an example, the second smaller size may allow the ball to move (e.g., from a first seat to a second seat, etc.). For example, consider the ball 316 degrading from a first size to a second size such that the ball 316, upon at least partial degradation, may become the ball 326 and seat in a seat for such a ball. As mentioned, a seat may be at least in part degradable, for example, to allow passage of a plug, which itself may be at least in part degradable.

As an example, at least a portion of a borehole tool may be broken via interaction with a tool where at least some of resulting pieces are degradable. For example, a tool may apply force (e.g., drilling force or other force) to a plug, a plug tool, etc. such that the applied forces causes breaking into pieces of at least a portion of the plug, at least a portion of the plug tool, etc. In such an example, the pieces may be relatively large and degrade to relatively small pieces (e.g., which may pass through one or more openings, etc.).

As an example, a high-strength material (e.g., greater than about 50 percent by weight metallic) may internally fracture (e.g., optionally at least in part dissolvable) following exposure to a corrosive fluid (e.g., an aqueous fluid). In such an example, the material may fracture internally due in part to one or more environmentally-reactive constituents of the material. For example, the material may include aluminum and gallium as an alloy. As an example, a material may optionally include one or more constituents, properties, etc. associated with one or more mechanisms such as, for example, weight-loss (e.g., uniform corrosion, etc.) and/or pitting.

As an example, corrosion of an aluminum alloy may commence with pitting. For example, pits may form within minutes of exposure to aqueous solution (e.g., salt, acidic, etc.). In such an example, where a surface oxide layer exists, pits may be formed at intersections of cracks in the surface oxide layer. In such an example, as exposure time increases, pits may become deeper and start to be connected by a network of intergranular corrosion paths. Such a process of pit-to-pit interactions can lead to pit clustering and coalescence. As an example, corrosion may cause exfoliation.

As an example, generation of an intergranular network following pit growth may facilitate transport of corrosive solution deeper into material. In such an example, the solution may react to produce hydrogen. For example, hydrogen may be generated at a front of a corrosion layer (e.g., at pit bottoms) and spreads to adjacent material regions that may establish a hydrogen diffusion zone below a corrosion zone. As to depth of attack (e.g., deepest location of a corrosion front as a function of time) may be determined via metallographic sections. As an example, a material may be characterized by a predictable attack depth as a function of time in a particular environment.

As an example, a material may include one or more constituents that promote hydrogen generation. As an example, a composite material may include grains of different materials where at least one of the materials includes aluminum. In such an example, one of the materials may include grains that have boundaries that provide for greater solubility of hydrogen (e.g., atomic hydrogen formation, etc.) than an aluminum alloy that includes aluminum oxide that acts as a kinetic barrier to hydrogen uptake (e.g., as formation of atomic hydrogen may be limited on an oxide surface). As an example, a composite material may include an aluminum alloy and another material where hydration of aluminum oxide of the aluminum alloy generates tensile stresses due to volumetric effects (e.g., size of hydrated aluminum oxide) and where the other material promotes formation of atomic hydrogen. In such an example, various mechanisms may cause the composite material to fracture (e.g., via "swelling" of aluminum oxide due to hydration and via hydrogen embrittlement).

As an example, a material may include lattice defects, which may include vacancies, dislocations, grain boundaries, etc. As an example, a material may be formed with lattice defects to promote degradation of the material. As an example, a material may be a composite material where one material generates lattice defects in the other material. For example, a composite material may include a predominant alloy where lattice defects in the predominant alloy exist due to presence of another material.

As an example, a material may internally fracture into debris (e.g., fracture degradation into debris). As an example, debris may be of an initial size and may successively become smaller (e.g., due to force, chemical, thermal, electrical, etc. phenomena). As an example, degradation of material may generate debris that may be of the order of a grain size. As an example, degradation of material may generate debris that may be of the order of a grain cluster. As an example, degradation of material may generate debris that may be of the order of a grain cluster and may generate debris that may be of the order of a grain size.

As an example, a material may degrade via corrosion where corrosion generates gas (e.g., or gasses) and/or solids. As an example, consider a corrosion process that causes an increase in volume of a material. In such an example, the increase in volume may cause internal tensile stresses to be generated within the material to cause internal fracturing. As an example, internal tensile stresses in a material may be generated via a process while additional external stresses are applied to the material. As an example, internal tensile stresses in a material may be generated via a process while ambient external stresses (e.g., normal stresses as existing in an environment) apply to the material.

As an example, a material may include at least one constituent that generates hydrogen gas. As an example, generation of hydrogen gas may occur in a pressure dependent and/or a pressure independent manner. As an example, generation of hydrogen gas may occur in a fluid dependent and/or fluid independent manner. As an example, generated hydrogen gas may enhance degradation of a material via hydrogen-embrittlement, which may lead to cracking (e.g., dislocations of the material along grain boundaries, etc.). As an example, a material may facilitate hydrogen trapping to enhance hydrogen-assisted fracturing of the material.

As an example, a material may include one or more constituents that can form a "cell" or "cells" within the material. For example, consider a component that following contact with an environmental fluid (e.g., an aqueous fluid) produces a concentrated cell that may be characterized by, for example, one or more of heat generation (e.g., to further promote degradation), a desired pH (e.g., for aluminum, low or high to enhance degradation), an electrical potential (e.g., to promote movement of electrons, ions, etc.), phase transition (e.g., to promote volumetric change, whether greater or smaller), mass transfer (e.g., liquid gallium that can diffuse via grain boundaries), etc.

As an example, a material may include as one of its components, a strong oxidizer. For example, consider a salt that includes oxygen atoms such as, for example, ammonium perchlorate ($NH_4ClO_4$). In such an example, oxidation may enhance degradation of a formed material in its environment of use. As an example, ammonium perchlorate may oxidize hydrocarbon materials (e.g., fuel oxidation).

As an example, an oxidizer may be an oxidizing agent. As an example, an oxidizing agent may be one of the following: ammonium perchlorate, ammonium permanganate, barium peroxide, bromine, calcium chlorate, calcium hypochlorite, chlorine trifluoride, chromium anhydride, chromic acid, dibenzoyl peroxide, fluorine, hydrogen peroxide, mangesium peroxide, nitrogen trioxide, perchloric acid, potassium bromate, potassium chlorate, potassium peroxide, propyl nitrate, sodium chlorate, sodium chlorite, sodium perchlorate and sodium peroxide.

As an example, a component may include multiple contacting materials (e.g., two or more) that can be adjacent to each other and geometrically arranged to form a granular structure (e.g., of various materials).

As an example, a material can include one or more reactive constituents that may participate in a reaction or reactions. As an example, a reaction may generate a product of the reaction where the product is generated at and/or migrates to a boundary between two or more grains. In such an example, the product may induce and/or facilitate fracturing. As an example, a product of a reaction may be located along boundaries between grains so as to induce fracture, optionally at triple junctions of grains.

As an example, a material may be a high-strength aluminum-based product that includes a first aluminum-based metal or alloy that is selected to be high-strength and susceptible to stress-corrosion cracking (e.g., chosen to be one or more of Al—Mg, Al—Cu, Al—Zn and Al—Li, optionally chosen to be 7075) and a second aluminum-based metal that is reactive (e.g., consider an aluminum alloy that includes one or more of magnesium, calcium, lithium, gallium, etc.

As an example, a material can be or include an aluminum-based material. As an example, consider one or more of an aluminum alloy from the 2xxx series and the 7xxx series. As an example, a material may include an aluminum alloy (e.g., as a "grain A") that is of a weight percent between about 1 percent and about 99 percent where, for example, remaining weight of the material may include, for example, an Al—Ga alloy (e.g., as a "grain B"), which may be between about 1 percent and about 99 percent in a formed composite alloy. In such an example, one or more additional materials may be included, for example, in a weight percent of about 0.01 percent to about 20 percent.

As an example, a material may be a heat treated material. For example, heat-treating may be applied to an age-hardenable material to produce a heat treated material that is age-hardened. In such an example, heat-treating may optionally occur in situ, for example, in a downhole environment. For example, a downhole environment may be at a temperature or temperatures that can age-harden an age-hardenable material. As an example, an age-hardened material may be susceptible to stress-corrosion cracking. For example, a material may be disposed in a downhole environment, age-hardened and then subject to stress-corrosion cracking. In such an example, age-hardening may beneficially facilitate desirable stress-corrosion cracking via one or more mechanisms.

As an example, a borehole tool can include a frangible degradable alloy that includes an oxidizable base element and at least one alloying element. For example, magnesium is oxidizable to form magnesium oxide and titanium is oxidizable to form titanium oxide. As an example, aluminum may be an alloying element with magnesium or may be an alloying element with titanium, noting that aluminum can also be oxidized to form aluminum oxide. Magnesium, titanium and aluminum (and various respective alloys) can, for example, upon exposure to air, immediately form surface films of respective metal oxides.

As an example, an oxidation process can involve transfer of electrons from a piece of metal (e.g., or an alloy) to oxygen molecules to form an oxide layer at the surface of the piece. An oxide layer (e.g., a metal oxide layer) may be a passivation layer, for example, a layer that may be a few atoms deep or other depth (e.g., depending on surface characteristics, etc.). A passivation layer may be a metal oxide layer (e.g., or metal oxides layer, etc.) that "binds" to a piece to provide some amount of "protection" (e.g., passivation), which can depend on conditions to which the piece is subjected (e.g., chemical environment, pH, temperature, etc.). For example, metal oxides of elements like iron tend to not bind tightly to a metal surface. As such, the metal oxide layer can tend to separate from a boundary between the metal oxide and metal (e.g., flaking off and exposing a new layer of metal to oxidation). Such a process may be referred to as oxidation-based corrosion (e.g., consider rusting of iron).

As an example, metals such as aluminum, magnesium and titanium can form oxide layers that can passivate against further oxidation, for example, depending on conditions to which the metals are subjected (e.g., passivating ability can depend on one or more factors such as pH, chemical environment, temperature, etc.). As an example, a frangible degradable alloy that includes one or more of aluminum, magnesium and titanium may be susceptible to one or more of intergranular corrosion, exfoliation, and stress corrosion cracking (SCC). For example, a frangible degradable alloy may be susceptible to environmentally-assisted cracking via one or more mechanisms.

As an example, a frangible degradable alloy can include titanium. In such an example, the alloy may be subjected to hydrochloric acid (e.g., in an aqueous environment). In such an example, the alloy may frangibly degrade via stress corrosion cracking (SCC). As an example, a method of environmentally-assisted cracking can include exposing a frangible degradable alloy that includes titanium to an aqueous environment that includes an acid that includes chlorine (e.g., consider hydrochloric acid, etc.). As an example, a frangible degradable alloy can include titanium and such an alloy may be exposed to methanol that includes halides, for example, to cause environmentally-assisted cracking of the alloy.

As an example, a frangible degradable alloy can include aluminum. In such an example, the alloy may be subjected to chlorides in an aqueous environment.

As an example, a borehole tool may include a frangible degradable alloy that includes one or more of aluminum, magnesium and titanium. For example, consider a magnesium and aluminum alloy or a titanium and aluminum alloy. As an example, a borehole tool may include a frangible degradable alloy that includes two or more elements that can form passivating oxide surface layers (e.g., upon exposure to air). In such an example, a base element can be an element that can form a passivating oxide surface layer (e.g., upon exposure to air). As an example, a material may be characterized by its ability to form a passivating oxide surface layer (e.g., upon exposure to air, etc.).

As an example, a material can include, for example, from about 0.1 percent to about 50 percent by weight magnesium. For example, consider a borehole tool that includes a frangible degradable magnesium alloy that includes less than 50 percent by weight magnesium and that includes aluminum as an alloying element. In such an example, the frangible degradable magnesium alloy of may include gallium as an alloying element.

As an example, a borehole tool can include a frangible degradable magnesium alloy that includes greater than 50 percent by weight magnesium and that includes aluminum as an alloying element. In such an example, the frangible degradable magnesium alloy may include gallium as an alloying element. As an example, consider a frangible degradable magnesium alloy that includes greater than 90 percent by weight magnesium. As an example, consider a frangible degradable magnesium alloy that includes less than 10 percent by weight aluminum and, for example, greater than 3 percent by weight aluminum. As an example, consider an AZ91 alloy (e.g., greater than about 90.11 weight percent Mg; about 8.99 weight percent Al; about 0.78 weight percent Zn and about 0.21 weight percent Mn). As an example, consider an AM60 alloy (e.g., about 93.5 weight percent Mg; about 6 weight percent Al; about 0.1 weight percent Zn; and about 0.35 weight percent Mn). As an example, consider an AS41 alloy (e.g., greater than about 94 weight percent Mg; about 4 weight percent Al; and about 1 weight percent Si).

As an example, consider a borehole tool that includes a frangible degradable titanium alloy that includes alpha phase titanium and at least one alloying element. For example, titanium alloys whose microstructures include mostly alpha phase, when exposed to an external hydrogen environment, can degrade via a mechanism that includes repeated formation and rupture of brittle hydride phase at, or very near, the gas-metal interface. As an example, a frangible degradable titanium alloy can include aluminum as at least one alloying element. As an example, a frangible degradable titanium alloy can include gallium as at least one alloying element. As an example, such an alloy may include aluminum and gallium.

As an example, a borehole tool can include a frangible degradable titanium alloy that includes alpha phase titanium and beta phase titanium and, for example, at least one alloying element. For example, in alpha plus beta phase titanium alloys, where a substantial amount of beta phase is present, hydrogen may be transported within the beta lattice and may react with the alpha phase along the alpha/beta boundaries. Such a mechanism may facilitate cracking of a titanium alloy. As an example, a titanium alloy can include one or more of molybdenum, silicon and vanadium as alloying elements.

As an example, a frangible degradable titanium alloy may include hydrogen as hydride, hydrogen in solid solution or hydrogen as hydride and hydrogen in solid solution.

As an example, a frangible degradable titanium alloy may be or include one or more of an Ti-6Al-4V alloy, an Ti-8Al-1Mo-1V alloy, an Ti-6Al-6V-2Sn, an Ti—Mo—Nb—Al alloy (e.g., with a beta phase susceptible to hydrogen embrittlement), an Ti—V—Cr—Al—Sn alloy (e.g., with a beta phase susceptible to hydrogen embrittlement), and an Ti—V—Fe—Al alloy (e.g., with a beta phase susceptible to hydrogen embrittlement).

As an example, a composite material can include particle sizes where a particle size of a first material in the composite material may be approximately the same as a particle size of a second material in the composite material. For example, consider a first material that includes a grain size characterized by an average maximum dimension (e.g., square root of a grain face area) and a second material that includes a grain size characterized by an average maximum dimension (e.g., square root of a grain face area) where the average maximum dimensions are approximately the same.

As an example, a material may be a composite material that includes one or more ceramic materials. For example, consider one or more of the following materials SiC, $B_4C$, $Al_2O_3$, and MgO, which may be provided, for example, as particles integrated into a composite material. As an example, one or more ceramic materials may act to control mechanical properties and degradability of a formed composite material.

As an example, a material may be characterized, at least in part, by an overall yield strength. For example, consider a material that is characterized, at least in part, by a yield strength of about 300 MPa (43 KSI) or more.

As an example, a material can include multiple types of grains. For example, consider a material with a grain type "A" and a grain type "B", and optionally one or more other grain types. As an example, such a material may be produced via one or more processes. For example, consider one or more powder-metallurgy processes. As an example, a material may be produced via one or more of sintering, hot-isostatic pressing (HIP or "HIPing"), spray deposition, equal channel angular extrusion or pressing (e.g., ECAE or ECAP), etc.

As an example, a material, which may optionally be a composite material, may be formed, machined, etc. as a part. As an example, such a part may be a part for implementation in a downhole flow-control operation. As an example, a part may be used for a fracturing operation. As an example, a part may be a drop ball, a frac dart, a plug, a receptacle, a seat, etc. As an example, a part may be an expandable structure and/or cooperate with an expandable structure that may facilitate control of fluid flow (e.g., fluid circulation, etc.).

As an example, a material, which may optionally be a composite material, may be formed, machined, etc. as a part that may be implemented in an operation that includes perforating. For example, consider a shaped-charge component, a shaped charged-loading tube, a perforation gun, etc.

As an example, a method can include using one or more materials, which may optionally include one or more composite materials, to form a skeleton (e.g., an internal scaffold) within a relatively more compliant surrounding medium or material (e.g., a cement, a polymer, etc.). In such an example, the one or more materials may be implemented to form, at least in part, a barrier between two or more regions. As an example, one or more materials may form, at least in part, a barrier between a region and another region. In such an example, the barrier may act to separate a fluid or fluids. As an example, a material may be used as a temporary fluid media separator (e.g., for zone isolation, flow control, etc.).

As an example, a material can include grains. In such an example, fracturing of the material (e.g., cracking of the material) may occur at a grain level. As an example, grains may be sized with an average face dimension of the order of about 1 micron to of the order of about 100 microns. As an example, grains may be sized with an average face dimension of the order of about 20 microns to of the order of about 60 microns.

Figure 4:
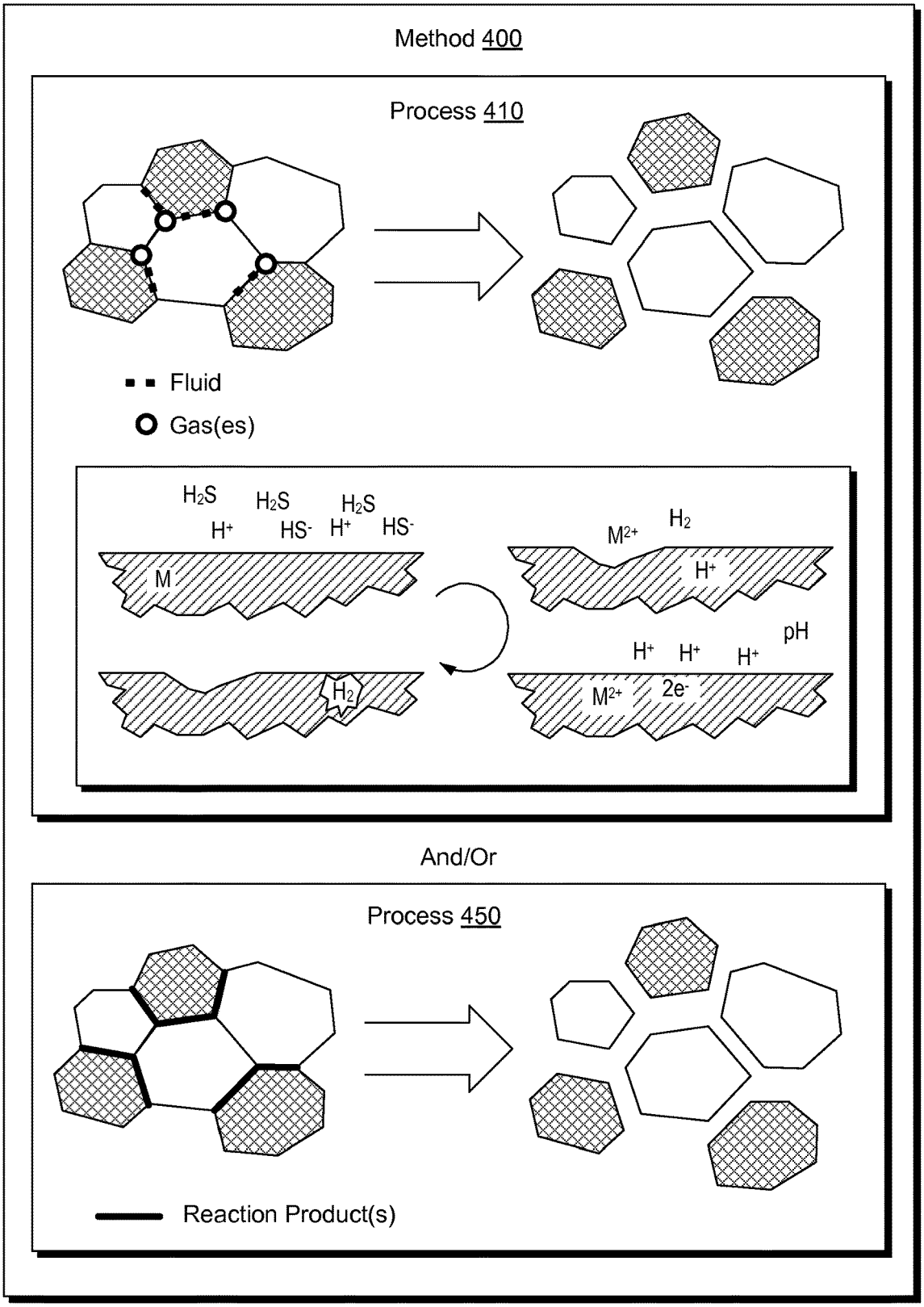
FIG. 4 illustrates examples of methods.

FIG. 4 shows an example of a method 400 that can include one or more processes such as, for example, one or more of the processes 410 and 450. The process 410 can include generating gas such as, for example, hydrogen gas. In such an example, the hydrogen gas may promote hydrogen embrittlement.

As an example, the process 410 may include formation of atomic or molecular hydrogen. Hydrogen embrittlement can occur in the presence of a source of atomic or molecular hydrogen, for example, consider hydrogen sulfide ($H_2S$) as a source. Susceptible alloys can react with $H_2S$ to form metal sulfides and atomic hydrogen as corrosion products (e.g., "byproducts"). Atomic hydrogen can combine to form $H_2$ at a metal surface, which may diffuse into a metal matrix, or within a metal matrix. However, as sulfur is a hydrogen recombination poison, the amount of atomic hydrogen that recombines to form $H_2$ may be reduced and thereby increase diffusion of atomic hydrogen into the metal matrix. With respect to diffusion of hydrogen into a metal matrix, formation of metal hydrides can reduce ductility and deformability. In turn, a metal matrix may become brittle and cracking may occur when exposed to tensile stresses. As an example, the process 410 may include forming atomic or molecular hydrogen in a manner that may form gas that can introduce tensile stress. In such an example, the hydrogen and the gas can enhance cracking.

As illustrated in FIG. 4, fluid diffusion may occur along grain boundaries (e.g., interfaces). In such an example, the fluid may be generated internally (e.g., in one or more cells, etc.) and/or may be from a fluid environment in which material is in contact. As illustrated, gas generation may act to generate "burst-pressure", for example, pressure that can build-up with material to induce internal stresses.

In FIG. 4, the process 450 can include one or more reactions between two or more different materials. For example, a grain of one material may be adjacent to a grain of another material. Such materials may react, for example, to form one or more reaction products. In such an example, a reaction or reactions may weaken interfaces between grains, which, in turn, may induce cracking.

As an example, a material may react to generate hydrogen. In such an example, the material may include an aluminum alloy, for example, consider an alloy that includes aluminum and gallium. As an example, a process may cause a material to fracture (e.g., crack) and a process may cause the material to dissolve. As an example, an aluminum alloy that includes gallium as an alloying element may dissolve following contact with water, optionally in a relatively pH independent manner (e.g., an aluminum-gallium alloy may dissolve over a wide range of pH from acidic to basic).

As an example, a material may include aluminum alloy that includes gallium as an alloying element. For example, consider a composite material of different types of alloys where an aluminum-gallium alloy is embedded within another alloy (e.g., grains of aluminum-gallium alloy adjacent to grains of another alloy) where the percentage of aluminum-gallium alloy may control, at least in part, one or more degradation processes. As an example, grains in a composite material may be characterized by shape, size, boundaries, etc. As an example, grains with certain characteristics may be included in a composite material with grains that may differ as to one or more characteristics.

As an example, a material or materials may be processed to form a part or parts. As an example, material or materials may be provided as powders. In such an example, a process may include mixing powders, which may act to randomly distribute one powder with respect to another powder.

As an example, processing of material may include spraying, compressing, sintering, casting, forging, machining, etc. As an example, a process may include machining a body of one material to form passages and at least partially filling the passages with another material, which may optionally be a composite material. In such an example, a part may be formed that is characterized by an initial integrity for a particular application and that is characterized by an ability to degrade. For example, the two materials may provide desired integrity while one or both of the materials may be subject to degradation (e.g., frangible degradation and/or dissolution degradation).

As an example, a material in passages of a body may degrade and thereby weaken the body such that the body may degrade. As an example, passages in a body may include openings at a surface or surfaces of the body such that in an aqueous environment water may contract material disposed in the passages, which may react to the water. For example, consider water interacting with aluminum oxide to form hydrated aluminum oxide that may exert internal stress on a body that may be sufficient to cause the body to crack. As an example, a material in passages of a body may dissolve following contact with water such that the body is weakened and subject to fracturing via existing external stresses and/or applied external stresses.

Figure 5:
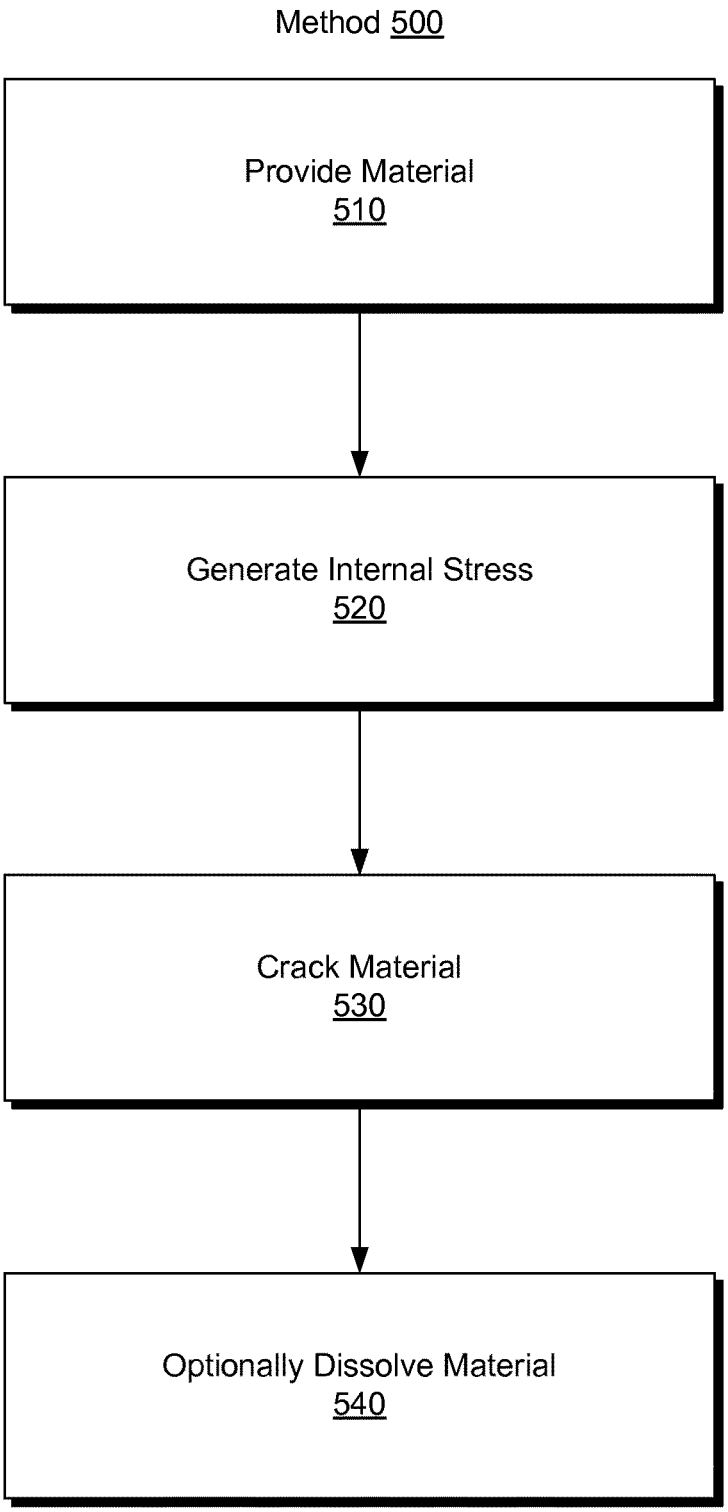
FIG. 5 illustrates an example of a method.

FIG. 5 shows an example of a method 500 that includes a provision block 510 for providing a material, a generation block 520 for generating internal stress in the material, and a crack block 530 for cracking the material at least in part responsive to the generated internal stress. As shown, the method 500 may also include a dissolution block 540 for dissolving at least a portion of the material.

As an example, a method can include generating internal stress in a material and micro-fracturing the material. Such a material may be, for example, formed as a part, a portion of a part, etc. Such a material may be of sufficient strength to perform one or more functions and may be degradable. As an example, a material may be homogeneously or heterogeneously degradable. As an example, a part may be, for example, a frac ball, a frac ball seat, etc. As an example, a part may be "self-removable", for example, for passageway opening, re-opening, etc.

As an example, internal stresses may be self-induced to generate in situ fractures in a high-strength metallic material. As an example, a material may be or include an age-hardenable aluminum alloy or alloys (e.g., 2xxx, 7xxx series or magnesium alloys). As an example, a material may be a composite material such as a composite metal or alloy that is fluid-sensitive (e.g., sensitive to water, etc.). In such an example, fluid may infiltrate the material and may react with one or more pre-imbedded reactive (e.g., degradable) phases. For example, by reacting a material with water, one or more imbedded phases (e.g. formed as grains) may in situ generate gas(es), which may be at least partially trapped within the material. In such an example, reactions may form one or more types of volumetrically increased byproduct solids. Thus, via one or more mechanisms, a material may generate internal stress that acts as internal "burst" pressure. As an example, localized tensile stresses may be generated that, via release thereof, result in in situ fracturing. As an example, a material may be characterized by an ability to assist or enable its removal and/or removal of one or more allied parts used in a downhole environment, optionally without altering external stress in the downhole environment. As an example, a part may be considered to be a "one-way" part where it travels downhole where it can degrade.

As an example, a part may be a drop ball suitable for implementation in one or more multi-stage fracturing applications. As an example, a drop ball that can degrade via generation of internal stress may be implemented in a FALCON™ system (Schlumberger Limited, Houston, Tex.). Such a system may be implemented for multistage stimulation where zones may be isolated during treatment operations, for example, in un-cemented horizontal, deviated, and/or vertical wells. Such a system may include swellable and/or hydraulically set packers to isolate multiple stages that may be treated. In such a system, balls may be dropped in an order of increasing diameter from a surface location to activate various individual stages. As an example, an operation may utilize one or more fluids such as, for example, a matrix acidizing fluid, a hydraulic fracturing fluid, etc.

Figure 6:
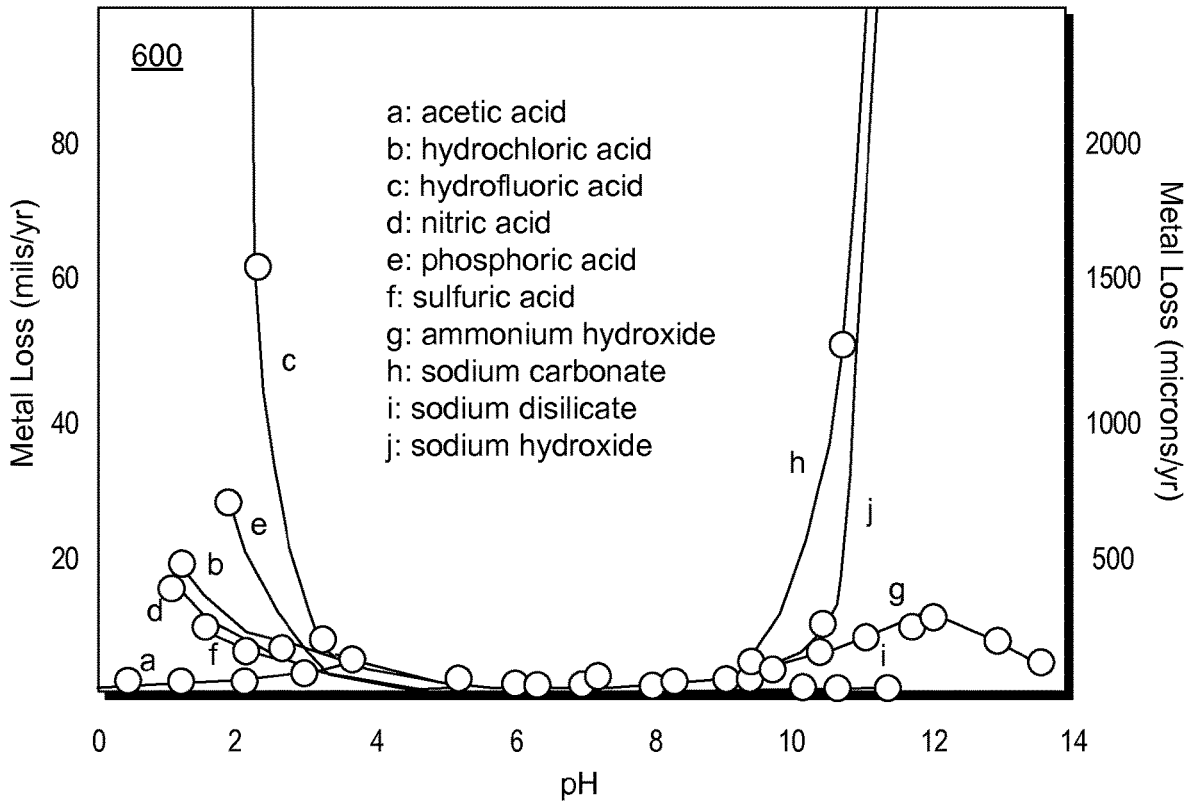
FIG. 6 illustrates an example of a plot.

FIG. 6 shows an example plot 600 of metal loss of aluminum in mils per year and in microns per year versus pH for various types of acids and/or bases (e.g., aqueous solution). As shown in the plot 600, corrosion (e.g., degradation) can occur at low pH (e.g., acidic environments) and at high pH (e.g., basic or alkaline environments).

Corrosion in an aluminum alloy can include anodic and cathodic reactions where and solution resistance may limit galvanic cell size. An anodic reaction of metal dissolution may be $Al \rightarrow Al^{3+}+3e^-$ while a cathodic reaction in oxygen reduction may be $O_2+2H_2O+4e^- \rightarrow 4OH^-$. As an example, hydrogen reduction may occur in acidified solution (e.g., consider $2H^++2e^- \rightarrow H_2$).

As an example, interaction between local cathodes and anodes and an alloy matrix can leads to various forms of corrosion in an aluminum alloy. For example, consider one or more of pitting corrosion, selective dissolution, trenching, intermetallic particle etchout, intergranular attack and exfoliation corrosion. Surface and subsurface grain etchout may be influenced by grain energy which may be derived from grain defect density. Grain etchout plays a role in exfoliation corrosion as the volume of hydrated aluminum oxide generated during dissolution is larger than the original volume of the grain.

As an example, a material can include aluminum that may form aluminum oxide. As an example, a material can include aluminum oxide. In such examples, upon contact with water, aluminum oxide may hydrate where the volumetric size of the hydrated aluminum oxide may generate internal stress in the material where such stress may act to fracture the material.

Thermodynamic principles that may explain and predict passivity phenomenon that may control corrosion behavior of aluminum may be presented via a Pourbaix-type analysis. For example, a plot of potential versus pH based on the electro-chemical reaction of one or more species involved may be presented as a Pourbaix diagram.

Figure 7:
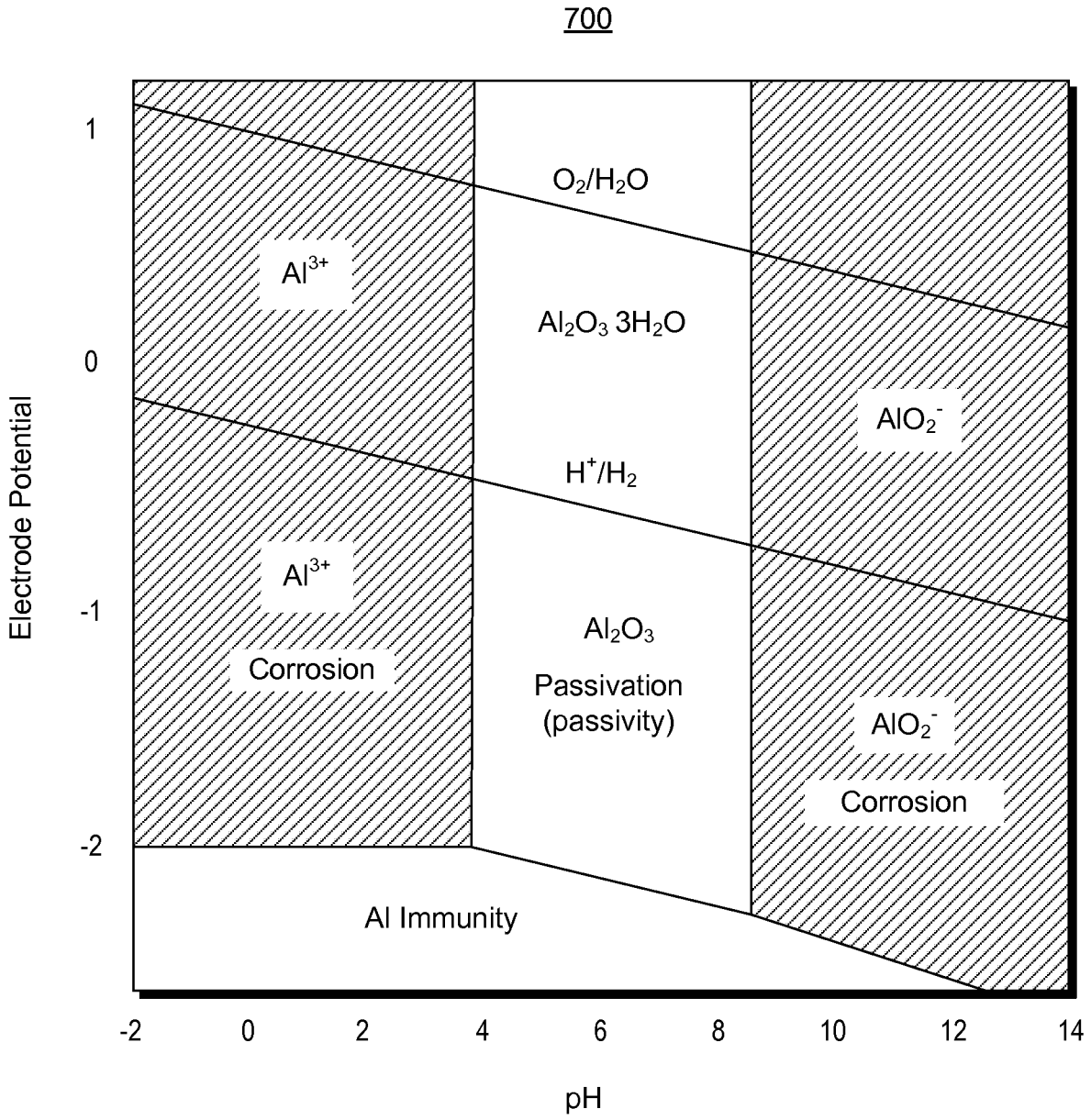
FIG. 7 illustrates an example of a plot.

FIG. 7 shows an example plot 700 of electrode potential versus pH for various forms of aluminum and aluminum compounds (e.g., a Pourbaix diagram). At high pH (e.g., pressure of about 1 atm), aluminum does not form a stable passive film, instead it dissolves in water and forms $AlO_2$ anions, as seen in the plot 700. As an example, a material may be subject to conditions that promote formation of local cells (e.g., in a fluid of variable pH compared to the environment) to promote degradation.

As shown in the plot 700, Al may be passive in the pH range of about 4 to about 9 due to the presence of an $Al_2O_3$ film. In environments that deviate from a near neutral range, continuity of such a film may be disrupted in which the film becomes soluble, facilitating a relatively rapid of dissolution the alloy. In an acidic range, Al may be oxidized by forming $A1^{3+}$, while $AlO^{2-}$ tends to occur in an alkaline range.

Corrosion of a material that includes aluminum may depend on one or more of presence of alloying elements, presence of substances in electrolyte (e.g., such as chloride, etc.), operating temperature of alloy, mode of corrosion, and rate of reaction. As an example, a material may be manufactured in a manner to exhibit predictable reaction kinetics when in a particular environment or environments.

As an example, a material may be manufactured to exhibit microstructure effects that promote fracturing (e.g., cracking). In such an example, kinetics may depend at least in part on one or more structural factors. As an example, a model of a material that can degrade may depend on thermodynamics (e.g., chemical reaction dynamics) and mechanics (e.g., stresses, etc.).

Figure 8:
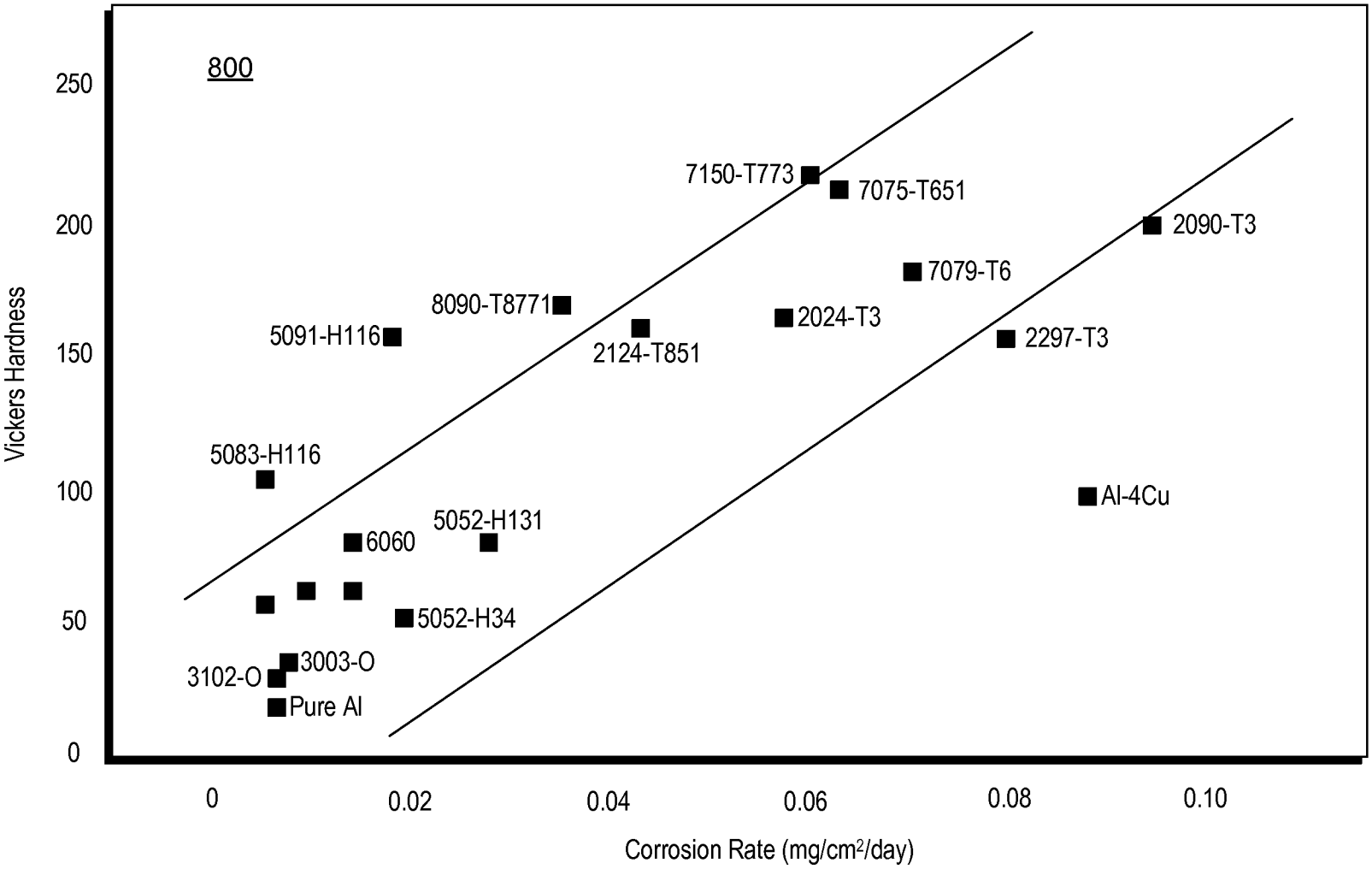
FIG. 8 illustrates an example of a plot.

FIG. 8 shows an example plot 800 of Vickers hardness versus corrosion rate for various materials. In the plot 800, trends are exhibited where an increase in hardness (e.g., as a proxy to yield strength) tends to correspond to an increase in corrosion rate. The plot 800 specifically shows corrosion rate as determined from weight loss data for commercial Al alloys collected after 14 days exposure in quiescent 0.1M NaCl.

The plot 800 tends to show two groups, one at each end of a corrosion rate spectrum. High hardness/strength aluminum alloys populate the high corrosion rate space, for example, in contrast to the medium to low hardness/strength alloys that exhibit considerably lower corrosion rates. The alloys that show the highest corrosion rates may be referred to as the precipitation hardenable family of alloys. Besides the high number density of precipitate particles in such alloys, they also tend to include an appreciable population of constituent type particles (e.g., as associated with up to 10 alloying elements). In the plot 800, alloys that exhibit the highest corrosion rates include appreciable amount of copper.

In an aluminum alloy, copper may participate in formation of cathodic particles capable of sustaining cathodic reactions locally and efficiently, such as $Al_2Cu$ and $AlCu_2Mg$. As an example, 2xxx series alloys may be considered to be copper rich; noting that copper also exists in 6xxx series alloys and 7xxx series alloys. As an example, a material can include copper and/or copper containing particles that are capable of supporting oxygen reduction. In such an example, one or more oxygen reduction reactions may facilitate degradation of the material, which may be, for example, a composite material.

As an example, a material may include aluminum and copper as an alloying element to form an aluminum-based alloy. In such an example, the aluminum alloy may be combined with one or more other materials to form a composite material that can facilitate degradation thereof via one or more mechanisms (e.g., frangible degradation and/or dissolution degradation). In such an example, the composite material may exhibit considerable hardness and be subject to corrosion that can facilitate degradation of the material where the material forms a part. For example, a part may be made of a composite material that includes an aluminum alloy with copper as an alloying element where the part is of a particular desired hardness for an application and where the composite material degrades to remove the part from a particular location in a downhole environment.

As an example, one or more materials may be added to an alloy material to form a composite material that can enhance weight-loss via corrosion. In such an example, galvanic corrosion may occur, for example, including an intra-galvanic cell degradation mechanism.

Figure 9:
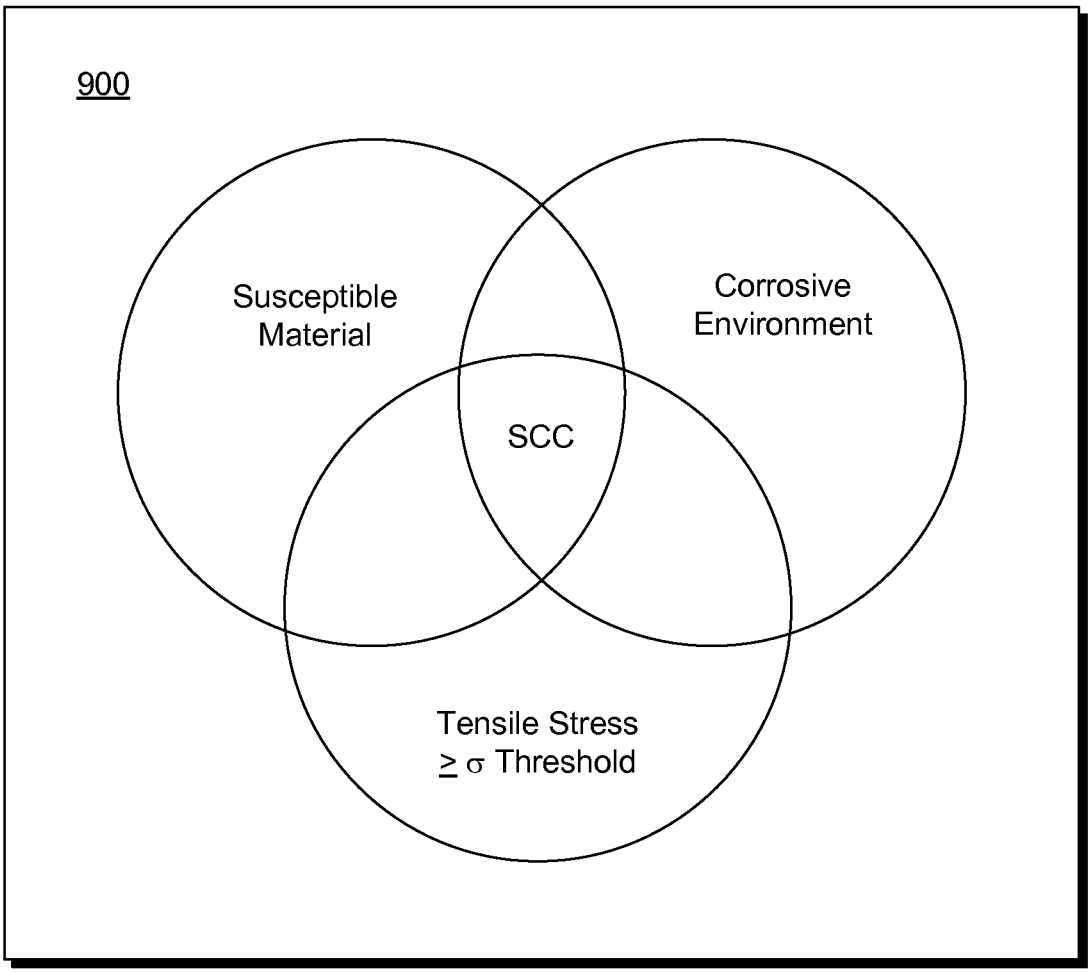
FIG. 9 illustrates an example of a plot.

FIG. 9 shows a diagram 900 that illustrates stress corrosion cracking (SCC), which is a type of corrosion process (e.g., a degradation process). As shown, SCC may occur given a susceptible material, a corrosive environment and a tensile stress that is greater than or equal to a stress threshold. In terms of temporal aspects, the three conditions represented in the Venn type of diagram 900 may occur simultaneously to promote SCC. SCC can cause a material or part to fail at a stress level below a material-rated yield strength (e.g., a frangible degradation mechanism).

As an example, a material or alloy can be susceptible (e.g., stronger or harder the material, the more susceptible to fracture providing the environment is conducive to SCC). As an example, an environment amenable to SCC may include one or more corrosive substances (e.g., halides like chlorides, etc.) and may be of a temperature that promotes kinetics, thermodynamics and/or mechanical degradation (e.g., expansion, different thermal conductivities, etc.). As an example, the more corrosive the conditions and the more likely fracture may occur as a result of imposed tensile stresses. As to tensile stresses, the greater the tensile stresses, the sooner a fracture or fractures may develop; further, below a certain threshold, cracking may not occur unless the environment or materials are made more amenable to stress-corrosion cracking.

Figure 10:
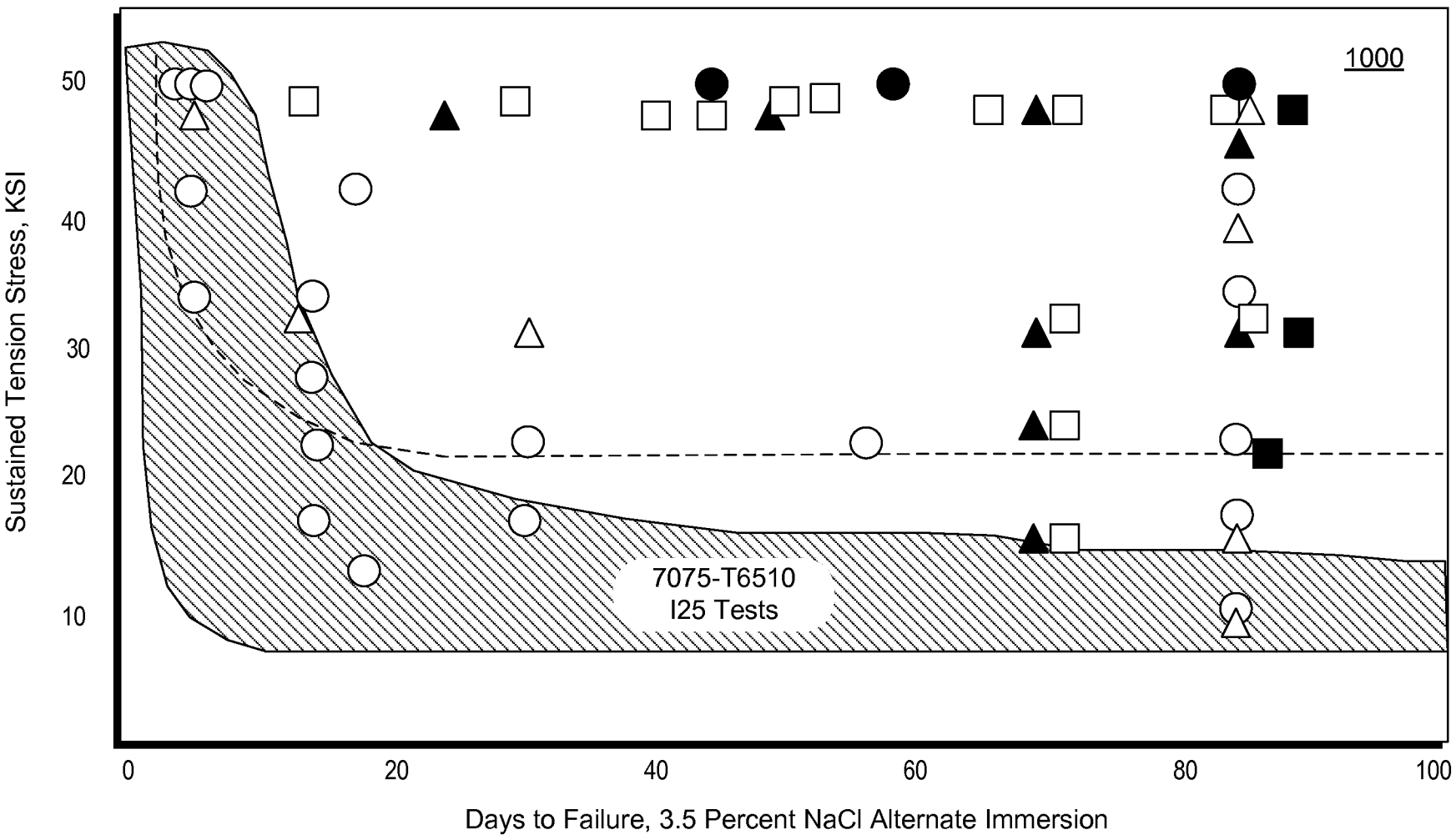
FIG. 10 illustrates an example of a plot.

FIG. 10 shows an example plot 1000 of sustained tension stress (KSI) versus days to failure in 3.5 percent NaCl (e.g., akin to seawater, a solution used in a fracturing operation, etc.).

In the plot 1000, for 7178-T76510 extension wing planks, open circles represent 11/16 inch thick 5/8 inch diameter C-rings and 1/8 inch diameter tensile specimens, filled squares represent 3/4 inch thick 7/10 inch diameter C-rings and open squares represent 1 1/4 inch thick. In the plot 1000, for 7178-T76510 extension bar, filled circles represent 1 1/2 inch by 1 3/4 inch 1/8 inch diameter tensile specimens. In the plot 1000, for 7075-T76510 extension wing planks, open triangles represent 11/16 inch thick 5/8 inch diameter C-rings and 1/8 inch diameter tensile specimens and filled triangles represent 1 1/4 inch thick 3/4 inch diameter C-rings and 1/8 inch diameter tensile specimens.

As illustrated in the plot 1000 of FIG. 10, for two high-strength aluminum alloys (7075 and 7178) in 3.5 percent sodium chloride, fractures can develop within days with high tensile stresses (e.g., yet still below yield). As shown in the plot 1000, where these tensile stresses are reduced (e.g., below 10 KSI), fracture no longer occurs. The plot 1000 illustrates that a minimum tensile stress (or threshold stress) is to be met to induce fracture (via SCC) in the 7075 and 7178 alloys.

Figure 11:
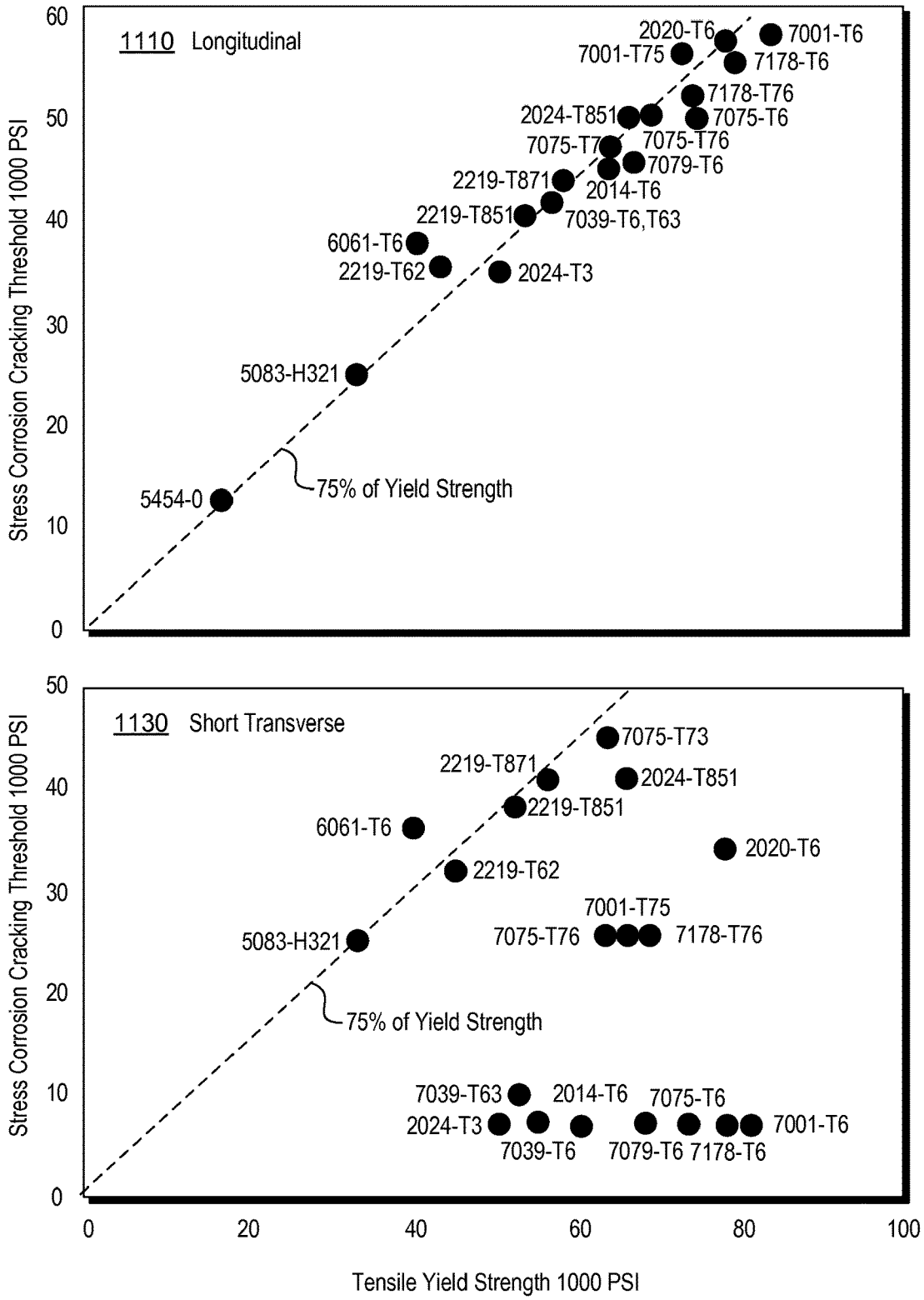
FIG. 11 illustrates an example of a plot.

FIG. 11 shows example plots 1110 and 1130 of stress corrosion cracking (SCC) threshold versus tensile yield strength for longitudinal and short transverse directions, respectively. Specifically, the plots 1110 and 1130 map out alloys in yield strength (x-axis) and cracking threshold (y-axis) and reveal alloys that are most susceptible to SCC. Note that the test materials inherently have high-strength (in excess to 30,000 PSI) and are therefore characterized by specific alloying elements and heat-treatment (e.g. age hardening). Alloys of particular interest for purposes of degradation exhibit elevated strength and relatively low SCC stress threshold (e.g., high susceptibility to SCC). For example, consider alloys that are located away from the dashed line in the plot 1130 (e.g., towards the bottom of the plot 1130), which include alloys from the 2xxx and 7xxx series (e.g., 2014-T6, 7079-T6, 7075-T6), among others.

Figure 12:
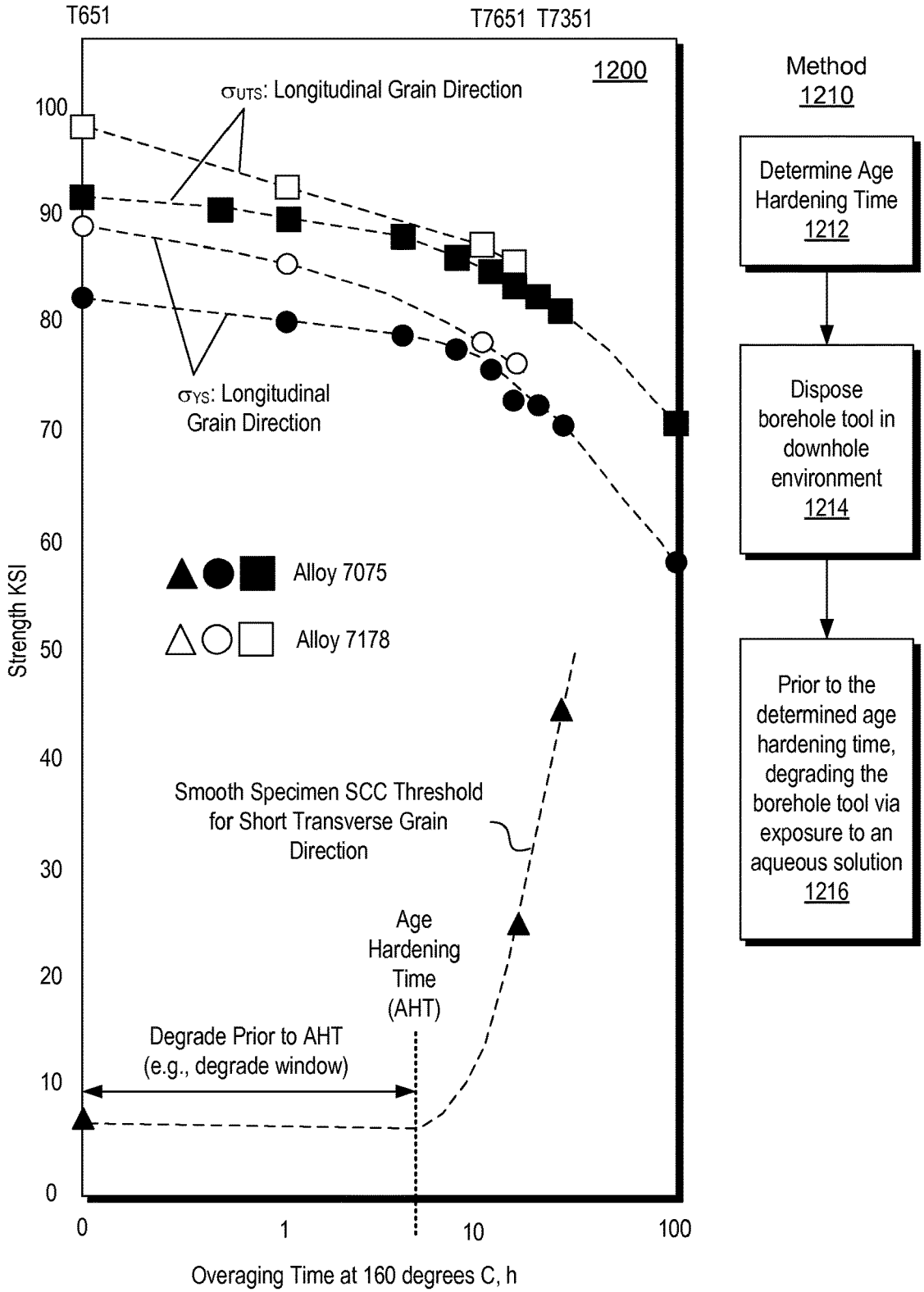
FIG. 12 illustrates an example of a plot and an example of a method.

FIG. 12 shows an example plot 1200 of strength (e.g., in KSI) versus overaging time at about 160 degrees C. (e.g., in hours) and an example of a method 1210. The plot 1200 shows correlation between aluminum alloy tensile strength and SCC threshold. As illustrated, alloys with high strength but low SCC susceptibility (e.g., high threshold) may be utilized to form a degradable part (e.g., a frangible degradable part).

As an example, a material such as 7079-T6 may be used. For example, consider the following composition ranges in weight percent for such an alloy: zinc 3.8-4.8, magnesium 2.9-3.7, copper 0.40-0.8, chromium 0.10-0.25, manganese 0.10-0.30, silicon 0.30 max., iron 0.40 max., titanium 0.10 max., additional impurities 0.5 individual max. to 0.15 total max., and aluminum balance.

As mentioned, temperature may be a factor in SCC. For example, temperature increases can increase SCC. As an example, a minimum threshold temperature may exist for various metallic materials, below which SCC may tend to be relatively uncommon. However, as mentioned, a process may include hydrogen embrittlement, which can occur at ambient temperatures. For example, a process may generate hydrogen where hydrogen facilitates degradation of a material (e.g., to assist in cracking of the material).

Referring again to the plot 1200 of FIG. 12, the effect of temperature (e.g., about 160 degrees C. or about 320 degrees F.) is illustrated on strength and SCC threshold of 7075-T651 and 7178-T651 aluminum alloys. As an example, a method can include prolonged exposure in a warm wellbore environment, which may, for example, cause a material to become less cracking susceptible as its strength diminishes due to over-ageing. Such a phenomenon may be used to controlled time-to-self destruction of one or more materials.

As to the method 1210 of FIG. 12, it includes a determination block 1212 for determining an age hardening time (AHT), a position block 1214 for positioning a borehole tool in a downhole environment and a degradation block 1216 for degrading (e.g., cracking) the borehole tool in the downhole environment via exposure to aqueous solution prior to the determined age hardening time (AHT).

As an example, a method can include positioning a borehole tool in a downhole environment where the borehole tool includes an age-hardenable material; and, prior to a predetermined age hardening time, degrading the age-hardenable material via exposure to an aqueous solution (e.g., frangible degrading of the material). In such an example, the predetermined age hardening time may corresponds to a reduction in susceptibility to stress corrosions cracking of the age-hardenable material. As an example, a method can include calculating an age hardening time based at least in part on temperature in a downhole environment. For example, an age hardening time may depend on temperature in a downhole environment.

As an example, a material may include one or more calcium-magnesium (Ca—Mg) alloys, calcium-aluminum (Ca—Al) alloys, calcium-zinc (Ca—Zn) alloys, magnesium-lithium (Mg—Li) alloys, aluminum-gallium (Al—Ga) alloys, aluminum-indium (Al—In) alloys, and aluminum-gallium-indium alloys (Al—Ga—In). As an example, a material may include about 80 weight percent aluminum, about 10 weight percent gallium and about 10 weight percent indium.

An alloy can include crystalline, amorphous or mixed structure (e.g. partially crystalline, partially amorphous). Features characterizing the structure can include grains, grain boundaries, phases, inclusions, etc. As an example, one or more features may be of the order of macroscopic, micron or submicron scale, for instance nanoscale. Shape, size, shape and size, etc. may be characteristics that can influence mechanical properties and, for example, reactivity.

As an example, a reactive material may include an element that tends to form positive ions when its compounds are dissolved in a liquid solution and whose oxides form hydroxides rather than acids with water. As an example, a material may disintegrate. For example, consider an alloy that loses structural integrity and becomes dysfunctional for instance due to grain-boundary embrittlement or dissolution of one of its elements. As an example, a byproduct of degradation from grain boundaries may not necessarily include an ionic compound such as a hydroxide and may include a metallic powder residue (e.g., consider severely embrittled aluminum alloys of gallium and indium).

As an example, a material may be electrically conductive and may include a metallic luster. As an example, a material may possess a relatively high mechanical strength in tension, shear and compression (e.g., exhibit a relatively high hardness).

Regarding alloying elements in an alloy, consider, for example, carbon (C) in iron (Fe) (e.g., in a steel, etc.). As an example, one or more of lithium (Li), magnesium (Mg), calcium (Ca), and aluminum (Al) may be included in a material that includes an alloy or alloys. Such metals or elements may, for example, act as metallic solvents, like iron in steels, or alloying elements, in dilute or high concentrations, like carbon in steels or chromium in stainless steels.

As an example, a material may be degradable and, for example, an alloy may be degradable (e.g., a degradable alloy). As an example, a material may degrade when subject to one or more conditions (e.g., over time). For example, consider one or more environmental conditions and/or "artificial" conditions that may be created via intervention, whether physical, chemical, electrical, etc. As an example, conditions can include temperature, pressures (e.g., including loads and forces), etc.

As an example, a degradable alloy may degrade at least in part due to formation of internal galvanic cells, for example, between structural heterogeneities (e.g. phases, internal defects, inclusions, etc.). As an example, a degradable material may resist passivation or, for example, formation of one or more stable protective layers.

As an example, a degradable alloy can include one or more alloying elements "trapped" in "solid solution". For example, consider aluminum, which may be impeded from passivating or building a resilient protective layer (e.g., aluminum oxide such as $Al_2O_3$). As mentioned, upon contact with water, aluminum oxide may become hydrated where size of hydrated aluminum oxide may introduce stress within a material that can facilitate cracking of the material. As an example, a process may include hydrating aluminum oxide where expansion may occur along boundaries of grains that leads to further intrusion of water and optionally other constituents in the water that may facilitate degradation of material.

As an example, a material can include concentrations of one or more solute elements, for example, trapped in interstitial and in substitutional solid solutions. As an example, concentrations, which may be spatially heterogeneous, of such one or more solute elements, may be controlled through chemical composition, processing, etc. As an example, consider rapid cooling where solubility is higher than at ambient temperature or temperature of use.

As an example, a material may include one or more elements or phases that liquate (e.g., melt, etc.) once elevated beyond a certain temperature, pressure, etc., which for alloys may be predictable from phase diagrams, from thermodynamic calculations (e.g., as in the CALPHAD method), etc.

As an example, a material may "intentionally" fail via liquid-metal embrittlement, for example, as in an alloy that includes gallium and/or indium. As an example, a degradable material may include an alloy or alloys and possess phases that may be susceptible to creep (e.g., superplastic)

deformation (e.g., under intended force, etc.), possess phases that are brittle (e.g., which may rupture in response to impact, etc.).

As an example, a degradable material may include a calcium alloy such as, for example, calcium-lithium (Ca—Li), calcium-magnesium (Ca—Mg), calcium-aluminum (Ca—Al), calcium-zinc (Ca—Zn), calcium-lithium-zinc (Ca—Li—Zn), etc. As an example, in a calcium-based alloy, lithium may be included in concentrations, for example, between about 0 to about 10 weight percent (e.g., to enhance reactivity, etc.). As an example, concentrations ranging from about 0 to about 10 weight percent of one or more of aluminum, zinc, magnesium and silver may enhance mechanical strength.

As an example, a material may include one or more magnesium-lithium (Mg—Li) alloys, for example, enriched with tin, bismuth and/or one or more other low-solubility alloying elements.

As an example, a material can include one or more alloys of aluminum. As an example, a material may include one or more of an aluminum-gallium (Al—Ga) alloy and an aluminum-indium (Al—In) alloy. As an example, a material may include one or more of an aluminum-gallium-indium (Al—Ga—In) and an aluminum-gallium-bismuth-tin (Al—Ga—Bi—Sn) alloy.

As an example, a material can include aluminum, gallium and indium. For example, consider a material with an alloy of about 80 weight percent aluminum, about 10 weight percent gallium and about 10 weight percent indium. Such a material may include Vickers microhardness (500 g) of about 32 (#1), 34 (#2), 34 (#3), 30 (#4), 35 (#5), 36 (#6) and 33 (average) and estimated strength of about 100 (MPa), 15 (ksi) and 1.5 (normalized).

As an example, a component may be formed of material that provides a desired degradation rate and desired mechanical properties (e.g., strength, etc.). As an example, a degradation rate may depend upon one or more conditions (e.g., temperature, pressure, fluid environments), which may be exist in an environment and/or may be achieved in an environment (e.g., via one or more types of intervention).

As an example, a method may produce a material such as, for example, a stainless steel, a nickel alloy (for HP & HT applications), or a degradable material.

As an example, a nickel alloy may be suitable for use in a harsh environment. For example, a harsh environment may be classified as being a high-pressure and high-temperature environment (HPHT). A so-called HPHT environment may include pressures up to about 138 MPa (e.g., about 20,000 psi) and temperatures up to about 205 degrees C. (e.g., about 400 degrees F.), a so-called ultra-HPHT environment may include pressures up to about 241 MPa (e.g., about 35,000 psi) and temperatures up to about 260 degrees C. (e.g., about 500 degrees F.) and a so-called HPHT-hc environment may include pressures greater than about 241 MPa (e.g., about 35,000 psi) and temperatures greater than about 260 degrees C. (e.g., about 500 degrees F.). As an example, an environment may be classified based in one of the aforementioned classes based on pressure or temperature alone. As an example, an environment may have its pressure and/or temperature elevated, for example, through use of equipment, techniques, etc. For example, a SAGD operation may elevate temperature of an environment (e.g., by 100 degrees C. or more).

As an example, a degradable material may be suitable for use in an operation that may include stages. For example, consider a cementing operation, a fracturing operation, etc. As explained with respect to FIGS. 1, 2 and 3, a process may be associated with a completion where portions of the completion are constructed, managed, altered, etc. in one or more stages. For example, cementing may occur in stages that extend successively deeper into a drilled borehole and, for example, fracturing may occur in stages.

As an example, such a material may be used as a component or as a portion of a component in a tensile-loaded application, for example, consider a bridge plug, etc. As an example, a bridge plug may be a tool, for example, a bridge plug tool. Such a tool may include one or more seats, which may, for example, provide for seating of one or more plugs.

Figure 13:
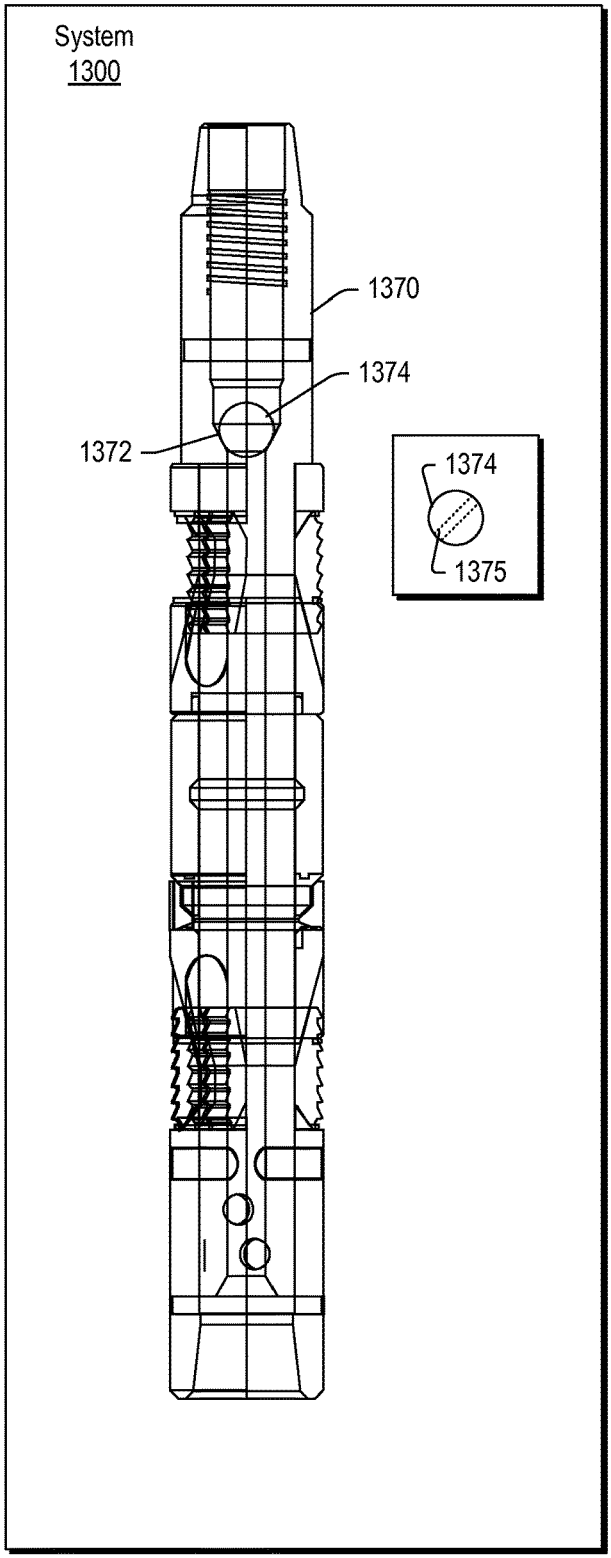
FIG. 13 illustrates examples of systems of equipment.

FIG. 13 shows an example of a system 1300, which may be a borehole tool or tools. As shown in FIG. 13, the system 1300 includes an example of a frac plug tool 1370 that includes at least one seat 1372 to seat a plug 1374, which may be a ball (e.g., a spherical frac plug). As an example, a valve of the frac plug tool may be defined at least in part by the seat 1372, which may be closed when the plug 1374 is dropped and becomes seated in the seat 1372. As an example, at least a portion of the frac plug tool 1370 may be at least in part frangible degradable (e.g., consider the seat 1372 as being at least in part degradable) and/or at least a portion of the plug 1374 may be at least in part frangible degradable. As an example, the plug 1374 can include one or more passages 1375 (e.g., optionally with material disposed therein). For example, the plug 1374 may be formed of a body of made of a frangible degradable material and may include one or more passages 1375 in which another material may be disposed (e.g., optionally a dissolvable material). In such an example, dissolution of material disposed in the one or more passages 1375 may weaken the body of the plug 1374. In such an example, external stress may be sufficient to cause the frangible degradable material of the body of the plug 1374 to crack into pieces. As an example, internal stress generated in the frangible degradable material may cause the body of the plug 1374 to crack into pieces. As an example, dissolution of material in passages of a body of the plug 1374 may allow fluid to enter and more readily contact interior surfaces of a body of the plug 1374, which may cause environmentally-assisted cracking of the body of the plug 1374.

As an example, a borehole tool may be a tool that is part of a borehole assembly (e.g., "BHA") or borehole system. As an example, a BHA may be a lower portion of the drillstring, including (e.g., from a bottom up in a vertical well) a bit, a bit sub, optionally a mud motor, stabilizers, a drill collar, a heavy-weight drillpipe, a jarring devices (e.g., jars) and crossovers for various threadforms. As BHA may provide force for a bit to break rock (e.g., weight on bit), survive a hostile mechanical environment and provide a driller with directional control of a borehole. As an example, an assembly may include one or more of a mud motor, directional drilling and measuring equipment, measurements-while-drilling tools, logging-while-drilling tools or other borehole tools.

As an example, a part may be a frac plug, which may optionally be a degradable frac plug (e.g., at least in part frangible degradable). As an example, a frac plug may be a layered plug, optionally including at least one degradable layer. As an example, a frac plug may include a core and one or more layers where at least one of the layers is degradable and optionally where the core is degradable. As an example, degradable layers, a degradable core, etc. may differ in properties in a manner that effects degradability (e.g., with respect to one or more conditions).

As an example, a borehole tool can include a frangible degradable alloy that includes an oxidizable base element and at least one alloying element. For example, consider magnesium as an oxidizable base element and, for example, aluminum as at least one alloying element. As another example, consider titanium as an oxidizable base element and, for example, aluminum as at least one alloying element.

As an example, a borehole tool can include a frangible degradable material that includes metallic grains where adjacent grains form hydrogen traps and form grain boundaries that transport aqueous solution. In such an example, the frangible degradable material can include aluminum.

As an example, a borehole tool can include a frangible degradable material that includes aluminum oxide where hydration of the aluminum oxide generates internal tensile stresses (e.g., that promote fracturing of the material).

As an example, a borehole tool can include a frangible degradable material that is a composite material formed of a plurality of materials. In such an example, at least one of the materials can include an aluminum alloy. In such an example, the aluminum alloy can include gallium as an alloying element.

As an example, a borehole tool can include frangible degradable material and includes a dissolvable material that is dissolvable in aqueous solution. As an example, a material may be frangible degradable and dissolvable in aqueous solution.

As an example, a borehole tool can include a body that includes passages where material is disposed in the passages. In such an example, the material as disposed in the passages can increase the strength of the body. Where the material is dissolvable, dissolution of the material may weaken the body such that the body may more readily fracture. In such an example, the body may be formed of a material that can weaken due to hydrogen embrittlement. As an example, a body may be formed at least in part of a frangible degradable material. As an example, a passage or passages in a body may include a frangible degradable material therein. As an example, a body may be formed at least in part of a frangible degradable material and the body may include one or more passages that include a dissolvable degradable material. In such an example, dissolution of the dissolvable degradable material in the one or more passages may structurally weaken the body such that frangible degradation of the body may more readily occur (e.g., such that the body may crack into pieces, etc.).

As an example, a borehole tool may be or include a frac ball formed at least in part of a frangible degradable material. As an example, a borehole tool may be or include a ball seat formed at least in part of a frangible degradable material.

As an example, a borehole tool may include an oxidizing agent. For example, consider ammonium perchlorate as an oxidizing agent.

As an example, a degradable material can be a composite material that includes a first aluminum alloy susceptible to stress corrosion cracking (e.g., frangible degradation) and a second aluminum alloy that is dissolvable. In such an example, the first aluminum alloy may include one or more of magnesium, copper, zinc and lithium as alloying elements (e.g., consider a 7075 aluminum alloy). As an example, a second aluminum alloy may include one or more of gallium, magnesium, calcium and lithium.

As an example, a borehole tool can include a composite material that includes an aluminum alloy of the 2xxx series or the 7xxx series (e.g., optionally susceptible to frangible degradation) and a water dissolvable aluminum alloy that includes gallium as an alloying element.

As an example, a method can include positioning a borehole tool in a downhole environment where the borehole tool includes an age-hardenable material; and, prior to a predetermined age hardening time, degrading the age-hardenable material via exposure to an aqueous solution. In such an example, the predetermined age hardening time can correspond to a reduction in susceptibility to stress corrosion cracking of the age-hardenable material (e.g., where stress corrosion cracking is a frangible degradation mechanism). As an example, a predetermined age hardening time can depend on temperature in the downhole environment.

As an example, one or more methods described herein may include associated computer-readable storage media (CRM) blocks. Such blocks can include instructions suitable for execution by one or more processors (or cores) to instruct a computing device or system to perform one or more actions. As an example, equipment may include a processor (e.g., a microcontroller, etc.) and memory as a storage device for storing processor-executable instructions. In such an example, execution of the instructions may, in part, cause the equipment to perform one or more actions (e.g., consider the equipment 120 and the controller 122 of FIG. 1, equipment of the system 300 of FIG. 3, etc.). As an example, a computer-readable storage medium may be non-transitory and not a carrier wave.

According to an embodiment, one or more computer-readable media may include computer-executable instructions to instruct a computing system to output information for controlling a process. For example, such instructions may provide for output to sensing process, an injection process, drilling process, an extraction process, an extrusion process, a pumping process, a heating process, etc.

Figure 14:
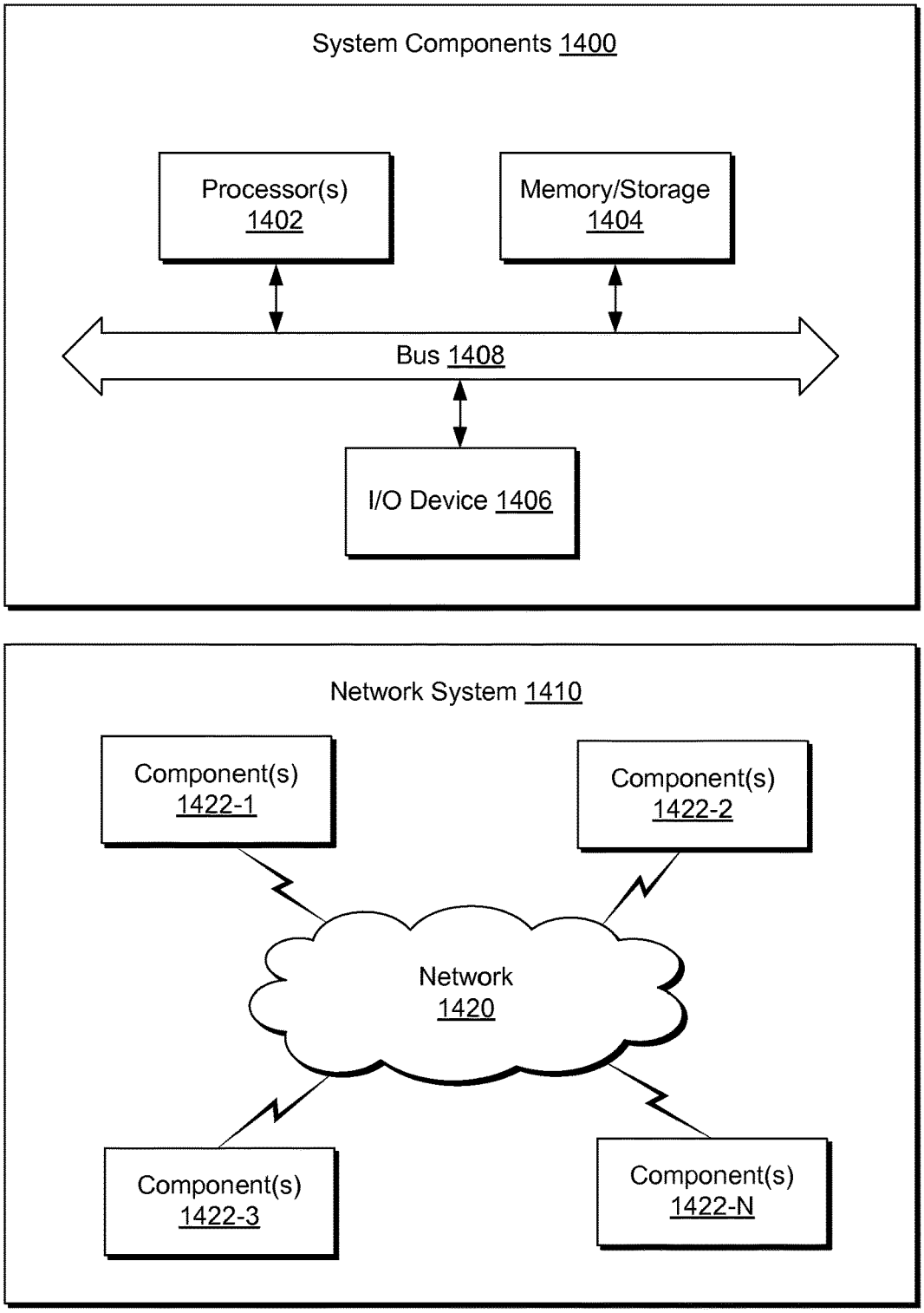
FIG. 14 illustrates example components of a system and a networked system.

FIG. 14 shows components of a computing system 1400 and a networked system 1410. The system 1400 includes one or more processors 1402, memory and/or storage components 1404, one or more input and/or output devices 1406 and a bus 1408. According to an embodiment, instructions may be stored in one or more computer-readable media (e.g., memory/storage components 1404). Such instructions may be read by one or more processors (e.g., the processor(s) 1402) via a communication bus (e.g., the bus 1408), which may be wired or wireless. As an example, instructions may be stored as one or more modules. As an example, one or more processors may execute instructions to implement (wholly or in part) one or more attributes (e.g., as part of a method). A user may view output from and interact with a process via an I/O device (e.g., the device 1406). According to an embodiment, a computer-readable medium may be a storage component such as a physical memory storage device, for example, a chip, a chip on a package, a memory card, etc.

According to an embodiment, components may be distributed, such as in the network system 1410. The network system 1410 includes components 1422-1, 1422-2, 1422-3, . . . 1422-N. For example, the components 1422-1 may include the processor(s) 1402 while the component(s) 1422-3 may include memory accessible by the processor(s) 1402. Further, the component(s) 1402-2 may include an I/O device for display and optionally interaction with a method. The network may be or include the Internet, an intranet, a cellular network, a satellite network, etc.

CONCLUSION

Although only a few examples have been described in detail above, those skilled in the art will readily appreciate that many modifications are possible in the examples.

Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. A borehole tool for use in a downhole environment comprising:

a frangible and dissolvable composite metallic material comprising:

a first granular alloy that is frangible, the first granular alloy comprising at least one selected from the group consisting of: a first aluminum alloy; a first magnesium alloy; and a titanium alloy, the first granular alloy being susceptible to stress corrosion cracking; and a second granular alloy that is dissolvable, the second granular alloy comprising at least one selected from the group consisting of: a second aluminum alloy; and a second magnesium alloy, the second granular alloy being dissolvable in oilfield fluids, wherein the second granular alloy is different from the first granular alloy, wherein dissolution of the second granular alloy causes the first granular alloy to further degrade into a plurality of smaller pieces.

2. The borehole tool of claim 1, wherein the first granular alloy comprises the first aluminum alloy, wherein the first aluminum alloy comprises aluminum oxide, and wherein hydration of the aluminum oxide generates self-induced internal tensile stresses in the first granular alloy.

3. The borehole tool of claim 1, wherein the second granular alloy comprises the second aluminum alloy, and wherein the second aluminum alloy comprises gallium as an alloying element.

4. The borehole tool of claim 1 comprising a frac plug formed at least in part of the frangible and dissolvable composite metallic material.

5. The borehole tool of claim 1 comprising a seat formed at least in part of the frangible and dissolvable composite metallic material.

6. The borehole tool of claim 1 further comprising: an oxidizing agent.

7. The borehole tool of claim 6 wherein the oxidizing agent comprises ammonium perchlorate.

8. The borehole tool of claim 1, wherein the first granular alloy comprises the first aluminum alloy, and wherein the second granular alloy comprises the second aluminum alloy.

9. The borehole tool of claim 8 wherein the first aluminum alloy comprises magnesium, copper, zinc and lithium as alloying elements.

10. The borehole tool of claim 8 wherein the second aluminum alloy comprises at least one selected from the group consisting of gallium, magnesium, calcium and lithium.

11. The borehole tool of clai1, wherein the first granular alloy comprises the first aluminum alloy, and wherein the first aluminum alloy comprises a 7079 aluminum alloy.

12. The borehole tool of claim 1, wherein the first granular alloy comprises the first aluminum alloy, and wherein the first aluminum alloy comprises a 7075 aluminum alloy.

13. The borehole tool of claim 1, wherein the first granular alloy comprises the first aluminum alloy, and wherein the first aluminum alloy comprises composition ranges in weight percentages as follows: zinc 3.8 to 4.8, magnesium 2.9 to 3.7, copper 0.40 to 0.8, chromium 0.10 to 0.25, manganese 0.10 to 0.30, silicon to a maximum of 0.30, iron to a maximum of 0.40, titanium to a maximum of 0.10, impurities to a maximum of 0.15, and aluminum to balance.

14. The borehole tool of claim 1, wherein the oilfield fluids are in a downhole corrosive environment, wherein the dissolution of the second granular alloy causes the first granular alloy to further degrade into a plurality of smaller pieces by producing at least one of hydrogen and a corrosion byproduct, which increases a volume of the frangible and dissolvable composite metallic material, and causes the first granular alloy to fail at a stress level below a material-rated yield strength of the frangible and dissolvable composite metallic material.

15. The borehole tool of claim 1, wherein the first granular alloy comprises the first aluminum alloy, and wherein the first aluminum alloy has a Vickers hardness above 150.

16. A method comprising:

positioning a borehole tool in a downhole environment wherein the borehole tool comprises a frangible and dissolvable composite metallic material comprising:

a first granular alloy that is frangible, the first granular alloy comprising at least one selected from the group consisting of: a first aluminum alloy; a first magnesium alloy; and a titanium alloy, the first granular alloy being susceptible to stress corrosion cracking; and a second granular alloy that is dissolvable, the second granular alloy comprising at least one selected from the group consisting of: a second aluminum alloy; and a second magnesium alloy, the second granular alloy being dissolvable in oilfield fluids, wherein the second granular alloy is different from the first granular alloy, wherein the frangible and dissolvable composite metallic material comprises an age-hardenable material; and prior to a predetermined age hardening time, dissolving the second granular alloy, which causes the first granular alloy to further degrade into a plurality of smaller pieces.

17. The method of claim 16 wherein the predetermined age hardening time corresponds to a reduction in susceptibility to stress corrosion cracking of the first granular alloy.

18. The method of claim 16 wherein the predetermined age hardening time depends on temperature in the downhole environment.

19. The method of claim 16, wherein the borehole tool comprising the frangible and dissolvable composite metallic material is a plug, wherein positioning the borehole tool in the downhole environment comprises dropping the plug from a surface location into a seat such that the plug seals against the seat, wherein the method further comprises setting a packer before dissolving the second granular alloy of the plug.

20. A method, comprising:

processing a frangible and dissolvable composite metallic material to form a borehole tool, the frangible and dissolvable composite metallic material comprising: a first granular alloy that is frangible; and a second granular alloy that is dissolvable, wherein the first granular alloy comprises at least one selected from the group consisting of: a first aluminum alloy; a first magnesium alloy; and a titanium alloy, the first granular alloy being susceptible to stress corrosion cracking, wherein the second granular alloy comprising at least one selected from the group consisting of: a second aluminum alloy; and a second magnesium alloy, the second granular alloy being configured to dissolve in oilfield fluids, wherein the second granular alloy is different from the first granular alloy, and wherein the second granular alloy is configured to dissolve, causing the first granular alloy to further degrade into a plurality of smaller pieces.

21. The method of claim 20, wherein the processing step comprises: mixing the first granular alloy with the second granular alloy.

22. The method of claim 20, wherein the processing step comprises:

forming a body made of the first granular alloy, the body comprising a plurality of passages;

disposing the second granular alloy within the plurality of passages of the body; and forming the body into the borehole tool.

* * * * *